US009700757B2

(12) United States Patent
Shade

(10) Patent No.: US 9,700,757 B2
(45) Date of Patent: Jul. 11, 2017

(54) ELONGATE TRACK AND SLIDABLE HANDLE APPARATUS AND METHOD OF MAKING

(75) Inventor: Matt Shade, Noblesville, IN (US)

(73) Assignee: PUM, LLC, Noblesville, IN (US)

( * ) Notice: Subject to any disclaimer, the term of this patent is extended or adjusted under 35 U.S.C. 154(b) by 0 days.

(21) Appl. No.: 14/124,077

(22) PCT Filed: Jun. 8, 2012

(86) PCT No.: PCT/US2012/041549
§ 371 (c)(1),
(2), (4) Date: Feb. 26, 2014

(87) PCT Pub. No.: WO2012/170815
PCT Pub. Date: Dec. 13, 2012

(65) Prior Publication Data

US 2014/0162857 A1 Jun. 12, 2014

Related U.S. Application Data

(60) Provisional application No. 61/494,487, filed on Jun. 8, 2011.

(51) Int. Cl.
*A63B 71/00* (2006.01)
*A63B 21/00* (2006.01)
(Continued)

(52) U.S. Cl.
CPC ..... *A63B 23/1236* (2013.01); *A63B 21/4035* (2015.10); *A63B 22/203* (2013.01);
(Continued)

(58) Field of Classification Search
CPC . A63B 22/205; A63B 22/203; A63B 22/0002; A63B 21/00101; A63B 21/1469;
(Continued)

(56) References Cited

U.S. PATENT DOCUMENTS 3,797,824 A * 3/1974 Osbourne ..... A63B 22/203 482/132
4,111,417 A * 9/1978 Gardner ..... 482/128
(Continued)

FOREIGN PATENT DOCUMENTS

AU 2011100023 2/2011
DE 9302848 U1 * 4/1993 ..... A63B 21/153
(Continued)

OTHER PUBLICATIONS (EP12797401.2) European Patent Office, European Search Report, Sep. 3, 2015.
(Continued)

*Primary Examiner* — Loan H Thanh
*Assistant Examiner* — Nyca T Nguyen
(74) *Attorney, Agent, or Firm* — Ice Miller LLP

(57) ABSTRACT

An apparatus includes a first elongate track and a second elongate track that are each substantially straight and adjustably coupled to a base member such that each track is configured to extend away from the base member in the opposite direction relative to the other track. The apparatus also includes a first handle slidably coupled to the first elongate track such that the first handle is movable along the length of the first elongate track and a second handle slidably coupled to the second elongate track such that the second handle is movable along the length of the second elongate track.

24 Claims, 39 Drawing Sheets

(51) Int. Cl.
*A63B 23/12* (2006.01)
*A63B 22/20* (2006.01)
*A63B 23/035* (2006.01)
*A63B 22/00* (2006.01)

(52) U.S. Cl.
CPC ..... *A63B 22/205* (2013.01); *A63B 23/035* (2013.01); *A63B 2022/003* (2013.01); *A63B 2210/50* (2013.01); *A63B 2225/09* (2013.01); *Y10T 29/49826* (2015.01)

(58) Field of Classification Search
CPC ..... A63B 2022/0005; A63B 23/1236; A63B 22/20; A63B 22/201; A63B 21/068; A63B 2225/093; A63B 23/02; A63B 23/0205; A63B 23/0216; A63B 23/1263; A63B 22/208; A63B 2022/206; A63B 23/1227; A63B 22/0023
USPC ..... 482/141
See application file for complete search history.

(56) References Cited

U.S. PATENT DOCUMENTS 4,506,884 A 3/1985 Hankin
4,529,194 A * 7/1985 Haaheim ..... A63B 21/012 482/70
4,733,858 A * 3/1988 Lan ..... A63B 23/1209 482/113
5,203,751 A * 4/1993 Chang ..... A63B 22/0002 482/51
5,643,162 A 7/1997 Landers
6,186,930 B1 2/2001 Ignaczak
6,976,943 B1 * 12/2005 Hsiung ..... 482/141
7,125,367 B1 * 10/2006 Stearns ..... 482/141
7,497,815 B1 * 3/2009 Caden ..... A63B 21/4047 482/135
7,981,005 B1 * 7/2011 Tsai ..... A63B 21/055 482/147
2004/0242381 A1 * 12/2004 Parmater ..... A63B 22/205 482/71
2005/0096194 A1 * 5/2005 Bond ..... 482/92
2005/0227836 A1 * 10/2005 Wen ..... 482/141
2005/0250628 A1 11/2005 Goldstein
2009/0298657 A1 * 12/2009 Potok ..... 482/141
2011/0077136 A1 * 3/2011 Tozzi ..... 482/141
2012/0053019 A1 * 3/2012 Reyes ..... A63B 21/00069 482/52
2012/0083396 A1 * 4/2012 Aquino ..... 482/131
2012/0258843 A1 * 10/2012 Summers ..... 482/93

FOREIGN PATENT DOCUMENTS

GB 2274999 8/1994
GB WO 2011030136 3/2011
IT WO 2008068793 6/2008
WO 2008068793 6/2008
WO 2011030136 A2 3/2011
WO 2011030136 A3 3/2011

OTHER PUBLICATIONS (EP12797401.2) European Patent Office, Written Opinion of the European Search Report, Sep. 3, 2015.
(EP12797401.2) European Patent Office, Supplementary European Search Report, Feb. 27, 2015.
(EP12797401.2) European Patent Office, Written Opinion of the Supplementary European Search Report, Feb. 27, 2015.

* cited by examiner

ELONGATE TRACK AND SLIDABLE HANDLE APPARATUS AND METHOD OF MAKING

CROSS REFERENCE TO RELATED APPLICATION

This application claims the benefit of the disclosure of international patent application PCT/US12/41549, filed on Jun. 8, 2012, which claims the benefit of the disclosure of U.S. Ser. No. 61/494,487, filed Jun. 8, 2011, both of which are herein incorporated by reference.

BACKGROUND OF THE DISCLOSED EMBODIMENTS

For most people, it is a struggle to fit exercise into their hectic schedule of everyday life. Many individuals attempt to visit an exercise facility before or after work. Other individuals walk or run in their community or in parks during the weekends. However, these traditional outlets for exercising are not practical for many individuals. For example, some may find it difficult to find time to even visit an exercise facility or a park. For such individuals, it would be beneficial to have exercise equipment that does not require a lot of area for use and that can be used at home or in other convenient locations. For others, it may simply be too expensive to join an exercise facility. Leaving aside the time and money necessary for traditional outlets for exercising, many individuals have difficulty finding or learning exercises that are effective. For many exercisers, the bench press or traditional push-ups are a staple exercise. However, the equipment that exercisers have traditionally utilized for push-ups or similar exercises fail to provide a standardized motion and the functional strength needed for the same. In addition, when performing such exercises, even advanced users will start to "cheat" or take less than an ideal position when fatigued. Further, while the bench press or push-ups are fine exercises, it would be advantageous to combine additional elements of the "fly" exercise and other movements to affect different muscle groups, including the core muscles. Accordingly, there exists a need for an exercise apparatus that is accessible and effective.

SUMMARY OF THE DISCLOSED EMBODIMENTS

The present disclosure discloses an exercise apparatus and a method of making the same. In an exemplary embodiment of the exercise apparatus, the apparatus includes a first elongate track and a second elongate track that are each substantially straight along their respective lengths. The first and second tracks are adjustably coupled to a base member such that each track is configured to extend away from the base member in the opposite direction relative to the other track. The apparatus also includes a first handle slidably coupled to the first elongate track such that the first handle is movable along the length of the first elongate track and a second handle slidably coupled to the second elongate track such that the second handle is movable along the length of the second elongate track.

In another exemplary embodiment of the exercise apparatus, the apparatus includes a first elongate track and a second elongate track adjustably coupled to one another and to a base member. Each track is configured to extend away from the base member in the opposite direction relative to the other track, and the first and second tracks and base member are coupled through a removable pin. The apparatus also includes a first handle that is slidably coupled to the first elongate track such that the first handle is movable along the length of the first elongate track and a second handle that is slidably coupled to the second elongate track such that the second handle is movable along the length of the second elongate track. The first and second tracks are adjustable together relative to the base member by removing the pin.

In an exemplary embodiment of the method of forming an exercise apparatus, the method includes attaching a first elongate track and a second elongate track that are substantially straight along their lengths to a base member such that the first and second elongate track members are configured to extend away from the base member in substantially opposite directions and are adjustable relative to the base member. The method also includes attaching a first handle to the first elongate track and a second handle to the second elongate track, wherein each handle is configured to move along the length of the respective track.

BRIEF DESCRIPTION OF THE DRAWINGS

The features and advantages of this disclosure, and the manner of attaining them, will be more apparent and better understood by reference to the following descriptions of the disclosed methods and systems, taken in conjunction with the accompanying drawings, wherein.

DETAILED DESCRIPTION OF THE DISCLOSED EMBODIMENTS

Figure 1:
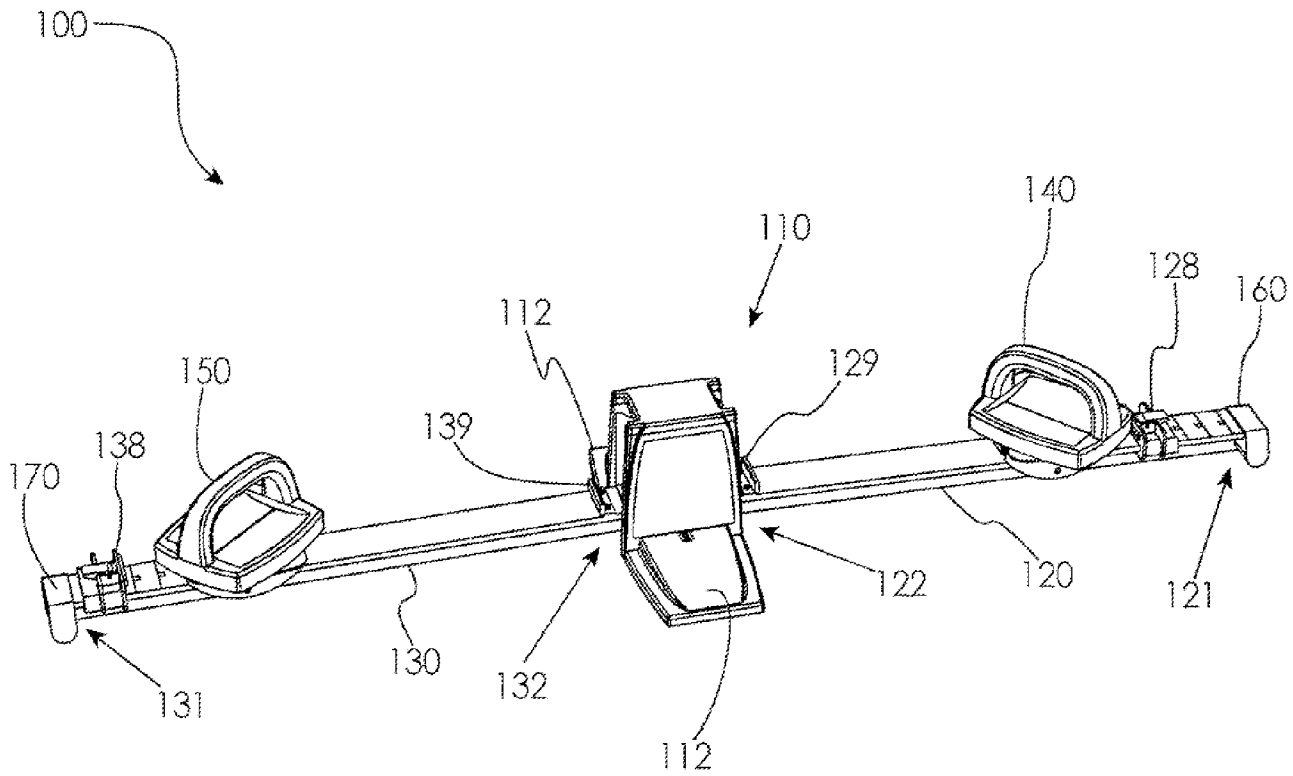
FIG. 1 shows a perspective view of an exercise apparatus according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 2:
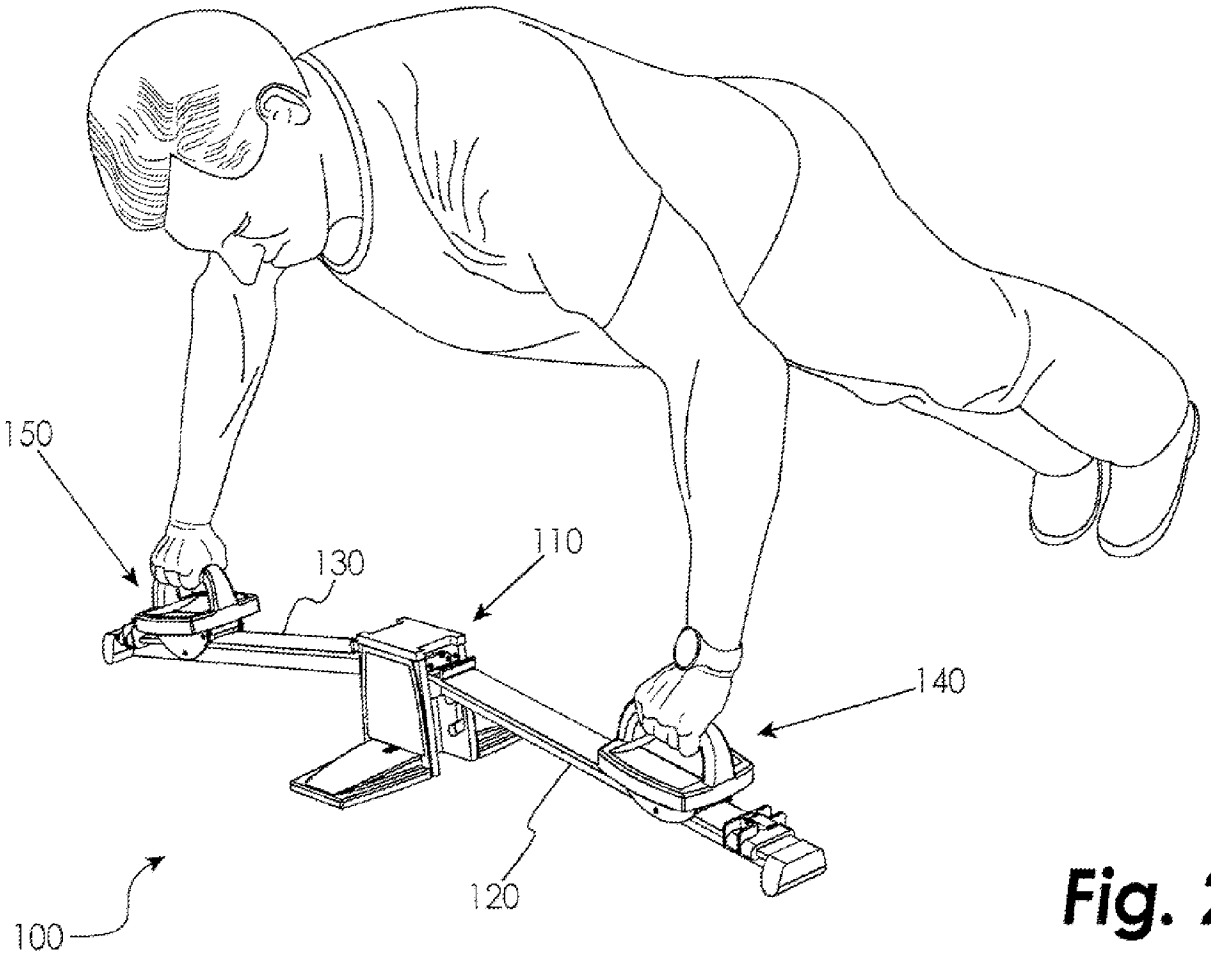
FIG. 2 shows a user performing push-ups on the exercise apparatus of FIG. 1 according to at least one embodiment of the present disclosure.
Figure 3:
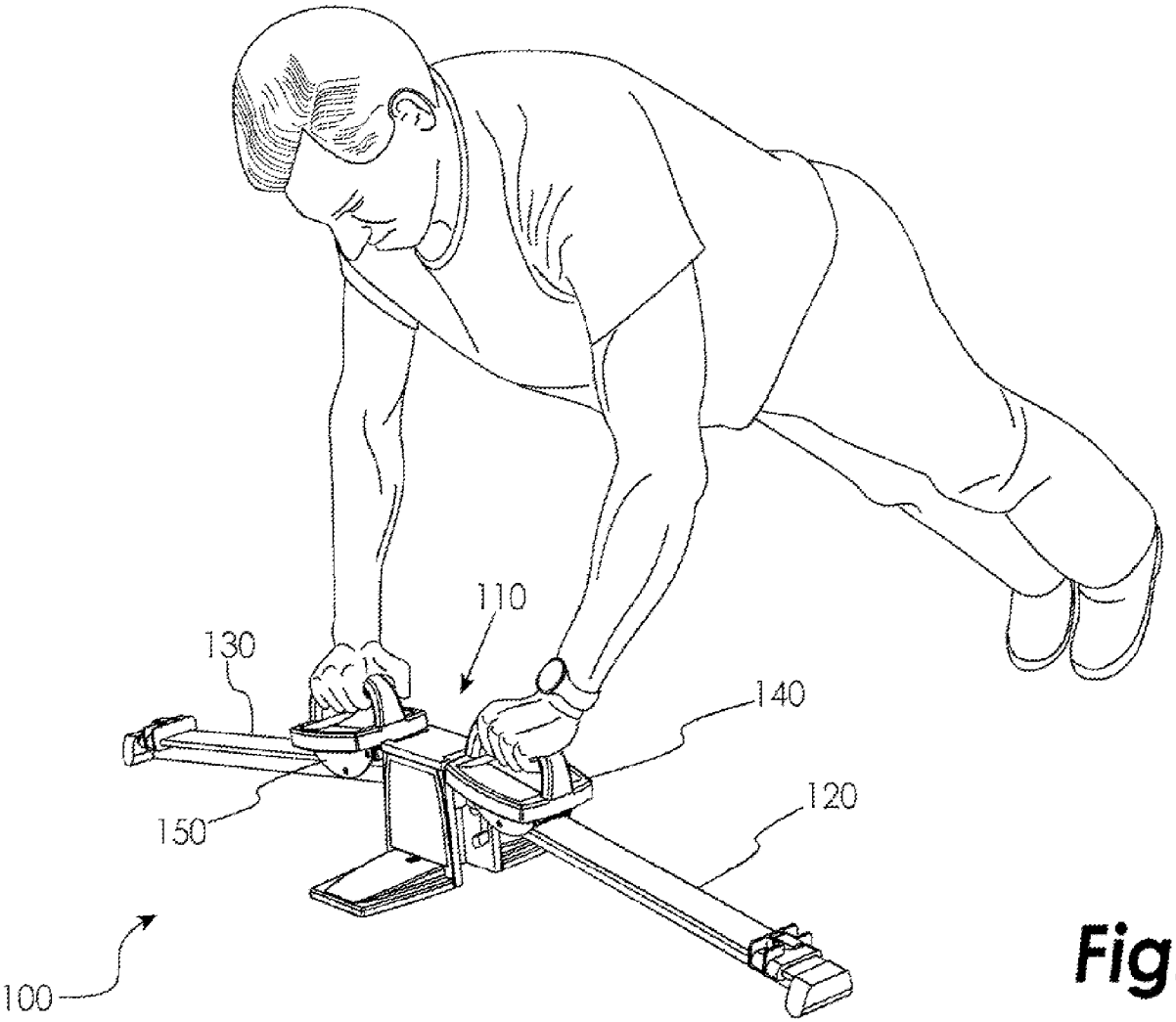
FIG. 3 shows a user performing push-ups on the exercise apparatus of FIG. 1 according to at least one embodiment of the present disclosure.

The present disclosure includes an exercise apparatus and method of making the same. The apparatus 100 is illustratively portable and provides individuals with the ability to exercise effectively in almost any location, at any time. One embodiment of an exercise apparatus 100 is shown in FIG. 1. Typically, the apparatus 100 may be used by an individual to perform a number of different push-up style exercises. For example, as shown in FIGS. 2 and 3, apparatus 100 is shown being used by an individual to perform one such exercise. In FIGS. 2 and 3, in order to carry out the exercise, the user moves the handles 140, 150 from a wide position (FIG. 2) to a narrow position (FIG. 3) by moving or sliding the user's hands via handles 140, 150 along tracks 120, 130. As described further below, users may adjust the apparatus 100 such that the user can perform different variants of push-up style exercises, including performance of such exercises at different inclines (or declines). Also, the apparatus 100 may be at least partially collapsible to allow portability and easy storage.

In FIG. 1, the apparatus 100 includes a base member 110 and a first track 120 and a second track 130 coupled to the base member 110. As shown in FIG. 1, the base member 110 may be partially hollow with open sides for receiving portions of first track 120 and second track 130. While the base member 110 in FIG. 1 has a substantially rectangular box shape, the base member 110 may be various shapes and sizes, including, but not limited to, square and trapezoid box shapes. The base member 110 may be formed of various types of materials, including, but not limited to, metal, composites, and plastic.

Figure 4A:
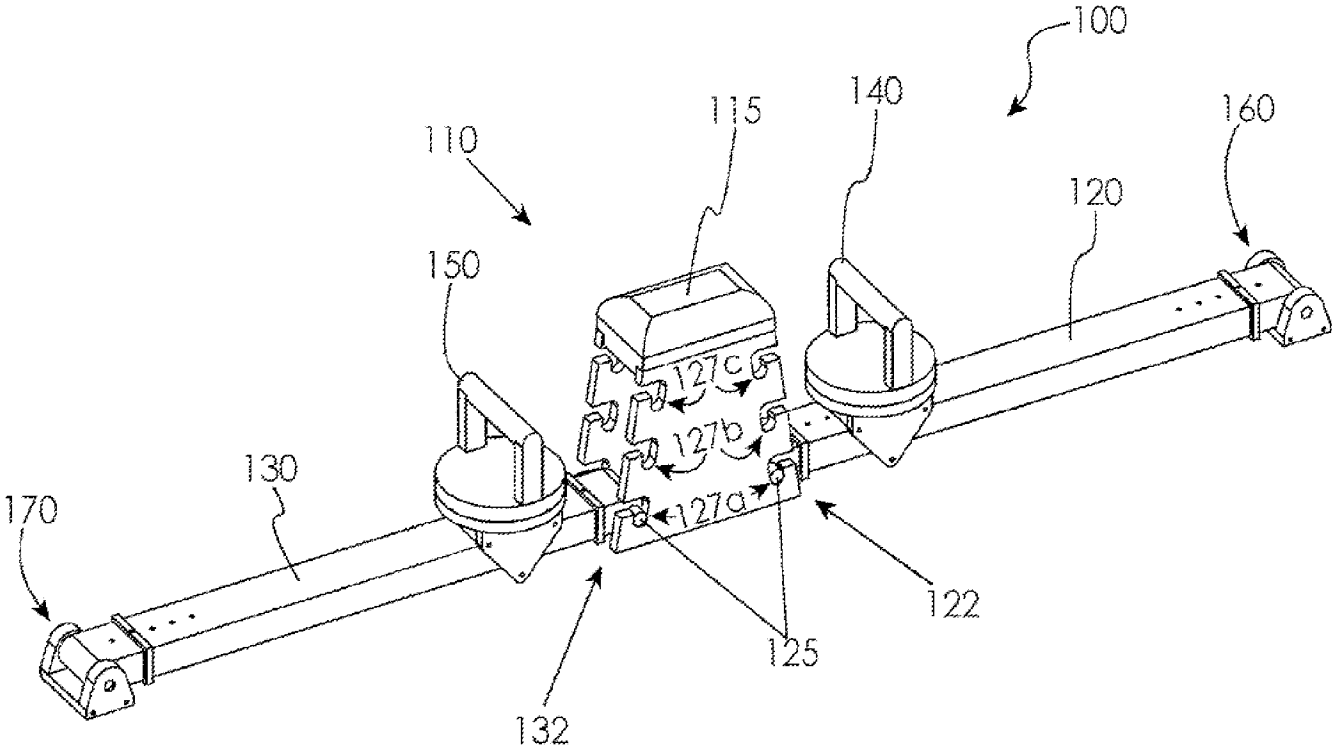
FIG. 4*a* shows a perspective view of an exercise apparatus according to at least one embodiment of the present disclosure.
Figure 4B:
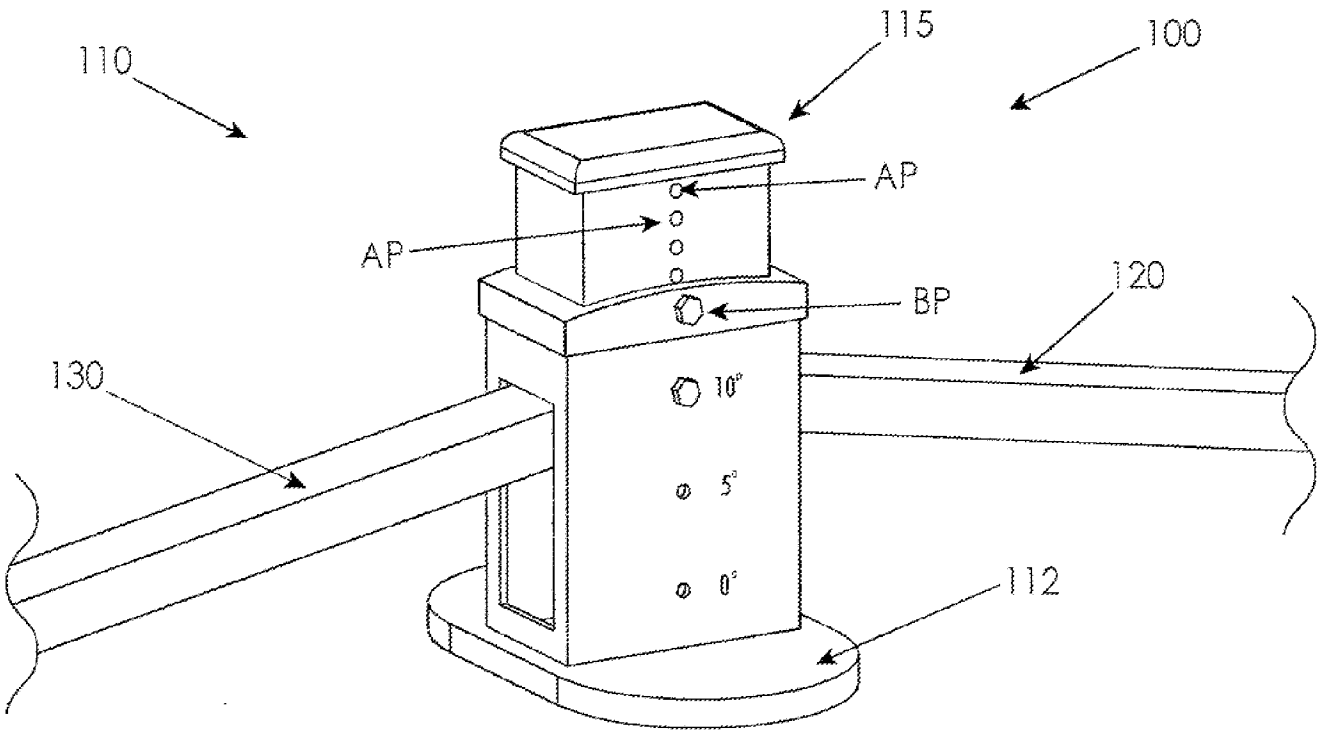
FIG. 4*b* shows an exercise apparatus having tracks coupled to the base member where the chest support is adjustable by pulling out a first pin from the base member and the tracks are adjustable relative to the base member by pulling out a second pin and inserting the pin in various holes in the base member according to at least one embodiment of the present disclosure.

As shown in FIG. 4*a*, the base member 110 of apparatus 100 may include a chest support 115. It should be noted that instead of being a part of the base member 110, the chest support 115 may be a separate part and attached to the base member 110. When the user of the apparatus 100 encounters the chest support 115 with his or her chest while performing a push-up, the user may be at least partially restricted from moving the user's chest any lower. In addition, when the user touches the chest support 115 with the user's chest, the user will understand that the user needs to push away from the chest support 115. This limitation of movement and notification function may help the user conduct more beneficial and effective push-ups or other exercises by eliminating unproductive movement or range, such as dipping the user's chest too low on a push-up. In an exemplary embodiment of the apparatus 100, the chest support 115 may be adjustable to various heights to accommodate, for example, different strength levels of a user by limiting the range of movement of a user. For example, as shown in FIG. 4*b*, the chest support 115 has been moved upward to increase the height of the base member 110. In FIG. 4*b*, the chest support 115 is adjustable via a pin P that is removably inserted through a portion of the base member 110 and through one of the plurality of apertures AP in the chest support 115. It should be noted that an adjustable chest support 115 may be beneficial for rehabilitative uses. For example, an individual with an injured shoulder or arm may use the apparatus 100 to perform physical therapy. In that case, the chest support 115 may be adjusted to a rehabilitative setting, which may, for example, provide the user with limited movement that nonetheless provides the range of motion that rehabilitates the user. Of course, the adjustable height of the chest support 115 above the base member 110 may also be beneficial to accommodate users who position their chests at different distances from the ground in, for example, the down position of the push-up. For example, the chest support 115 may be adjustable such that it is between six and eight inches above the ground or adjustable to a user's arm length. The chest support 115 may be adjustable to various configurations, such as, for example, any height up to ten inches above the ground, any height up to twenty inches above the ground, any height up to thirty inches above the ground, and various other heights so as to allow users with the option of dipping relatively less during the exercise.

The chest support 115 may be adjustable relative to the base member 110 through various mechanisms, such as, for example, a screw or adjustable locking device (e.g., tilt and lift mechanism, handle/pad combo that can be twisted to lock or unlock to adjust position). As noted above, in FIG. 4*b*, the chest support 115 is adjustable using a pin P that can be received through apertures AP in the chest support 115. One or more additional chest supports or boosters (not shown) may be placed on top of the chest support 115 (e.g., nested on one another) or integrated therewith to provide the desired height of the base member 110 (and therefore the apparatus 100) or a user may select from interchangeable, different-sized chest supports 115 to obtain the desired height. The additional chest supports or boosters may be snapped to complementary snaps on chest support 115, attached via hook and loop fasteners, shaped to interlock with chest support 115 and one another, at least partially recessed into chest support 115, or combined or attached to the chest support 115 in another way.

The chest support 115 and/or any or all of the additional chest supports or boosters (if any) may comprise a cushion or the like to reduce any discomfort when the user's chest contacts the chest support 115. In one configuration, a pressure sensitive switch is included in chest support 115 and includes an indicator, such as a light, audio generation circuitry, or another indicator, to notify the user he or she has completed a rep and/or count the number of reps.

Figure 4C:
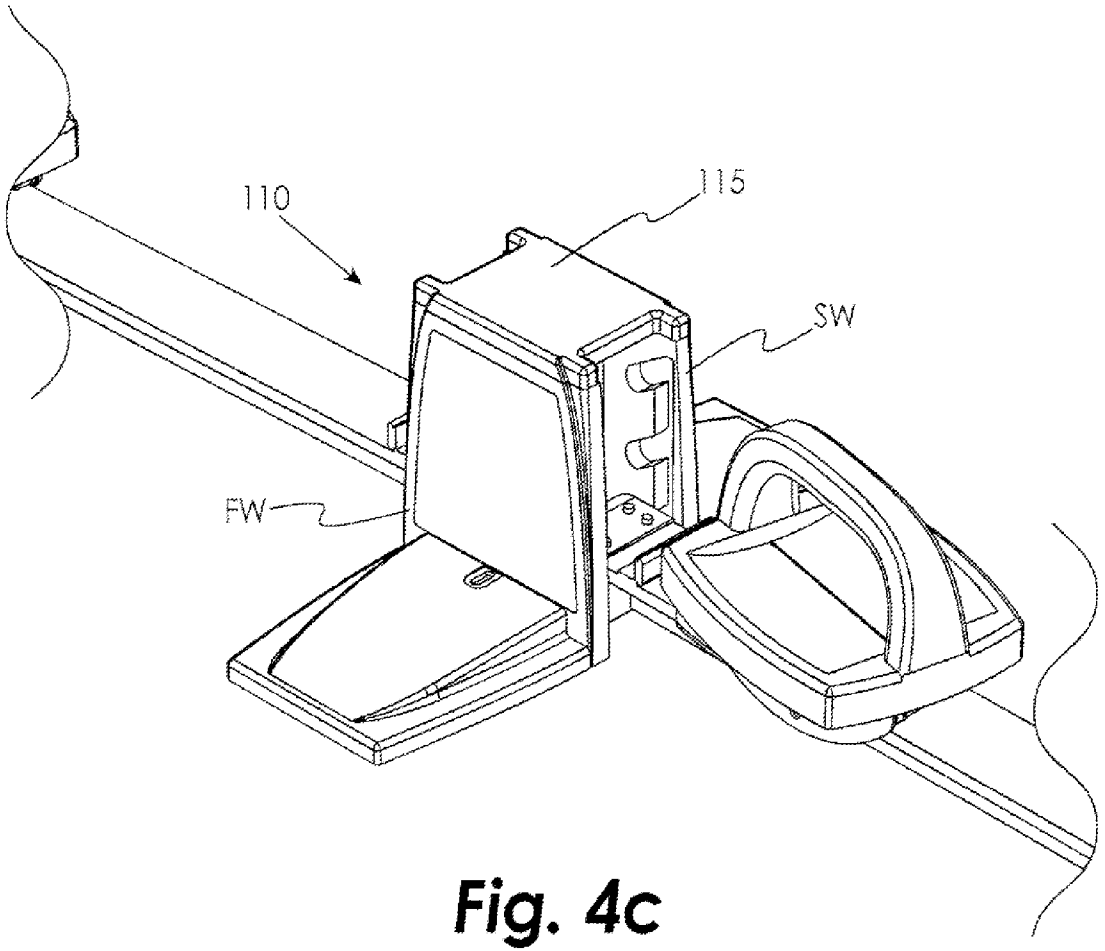
FIG. 4*c* shows a perspective view of a base member of an exercise apparatus with tracks coupled to the base member according to at least one embodiment of the present disclosure.

FIG. 4*c* shows a magnified view of the base member 110 in FIG. 1. As shown in FIG. 4*b*, the base member 110 includes a first wall FW and a second wall SW. When apparatus 100 is in the use position as shown in FIG. 4*c*, the first wall FW and second wall SW extend generally upwardly from the floor. Illustratively, first and second walls FW, SW are spaced apart a distance that approximates the width of tracks 120, 130.

Figure 4D:
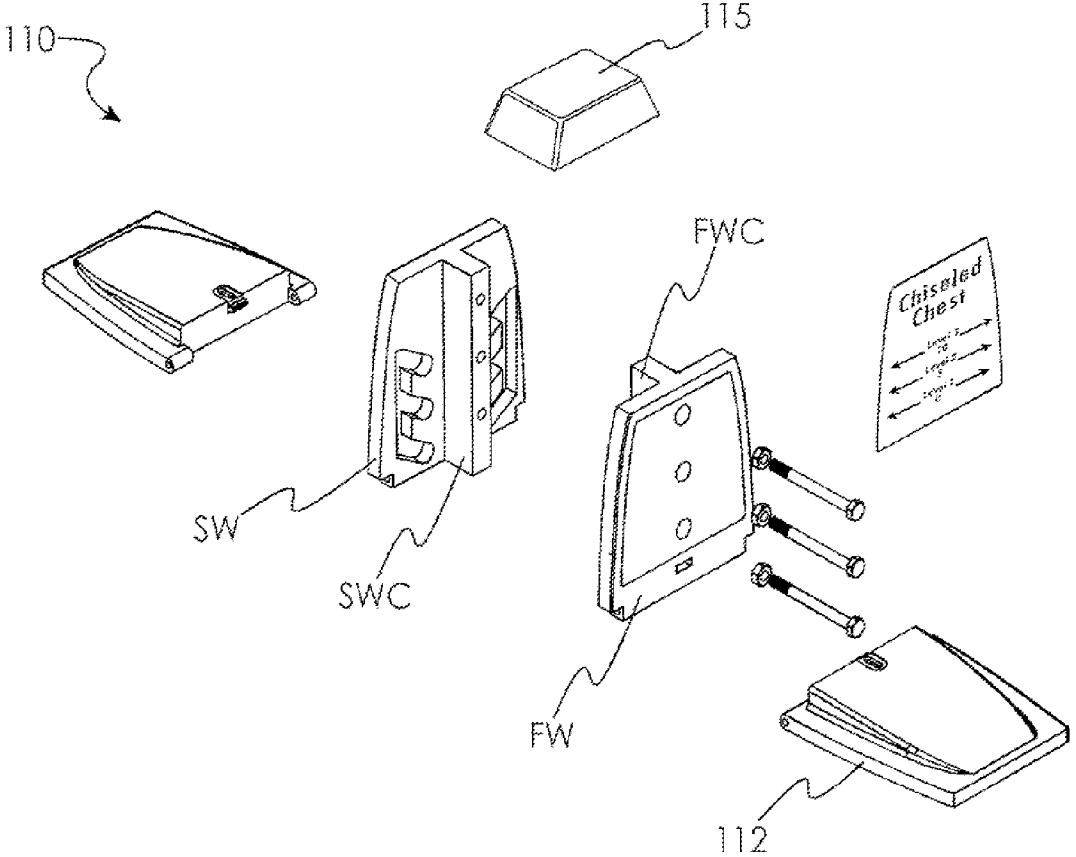
FIG. 4*d* shows an exploded view of a base member according to at least one embodiment of the present disclosure.
Figure 4E:
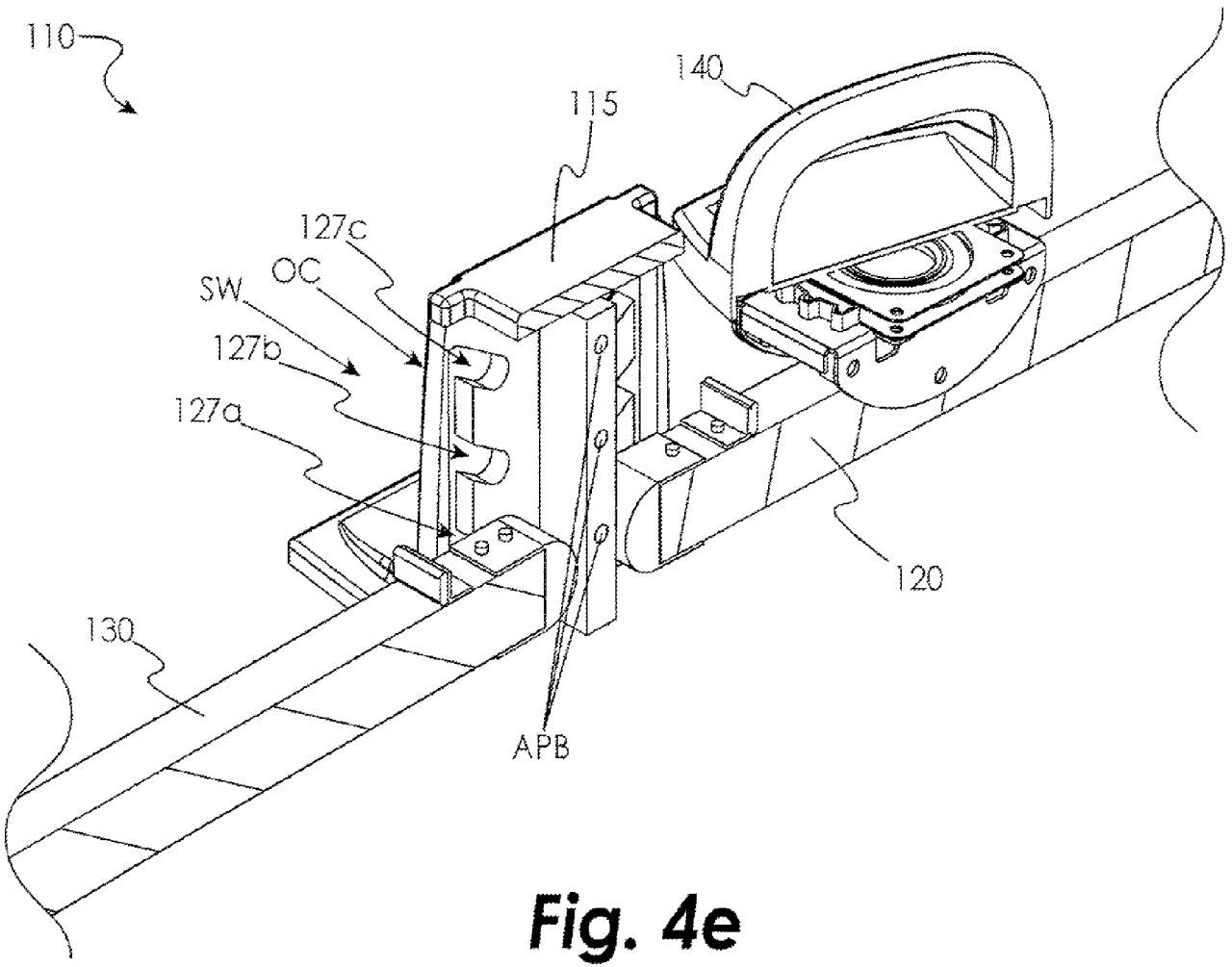
FIG. 4*e* shows a cross sectional view of a base member with tracks coupled thereto according to at least one embodiment of the present disclosure.

First and second walls FW, SW may be joined together or otherwise linked in various ways. For example, FIG. 4*d* shows an exploded view of the housing in FIG. 4*c*. As shown in FIG. 4*d*, the first wall FW includes a first connection portion FWC that extends out from an inside surface of the first wall FW, and the second wall SW includes a second connection portion SWC that extends out from an inside surface of the second connection portion SW. While the first connection portion FWC and second connection portion SWC can be part of the first wall and second wall, respectively, the first and second connection portions FWC, SWC may be independent parts that are attached to the respective inner surfaces of the first and second walls FW, SW. As shown in FIG. 4*d*, the first and second connection portions FWC, SWC may be elongate with rectangular cross-section. In FIG. 4*d*, the first and second connection portions FWC, SWC are configured to mate with one another (SWC is configured to receive at least a portion of FWC) to allow the first wall FW and second wall SW to be connected. As shown in FIG. 4*d*, the first wall and second wall FW, SW may be secured together through the use of bolts and nuts, where the first and second walls FW, SW are configured to receive such bolts via apertures within the walls FW, SW and first and second connection portions FWC, SWC. FIG. 4*e* shows a magnified perspective view of a cross-section of the base member 110 in FIG. 1. As shown in FIG. 4*e*, the second wall SW includes a second connection portion SWC that has apertures APB configured to receive bolts or other fastening devices to secure the first and second walls FW, SW together.

The first and second walls FW, SW may be connected in other ways or the base member itself may be manufactured as a unitary body such that the walls FW, SW are integral with a connection part between the two walls FW, SW. It should be noted that each of the walls FW, SW may have a thickness of approximately one-half inch, illustratively. It should also be noted that one or both of the walls FW, SW may be thicker and/or flare out adjacent surfaces of the base member 110 that touch the ground when the apparatus 100 is in use. For example, the thicker portions of the walls FW, SW may be, about 2-3 inches thick, while the other portions of the walls FW, SW may have smaller thicknesses. By having a thicker portion (or flared out portion) adjacent the surfaces of the base member 110 that touch the ground, the walls FW, SW can provide a more substantial base that enhances stability for the apparatus 100.

Figure 5:
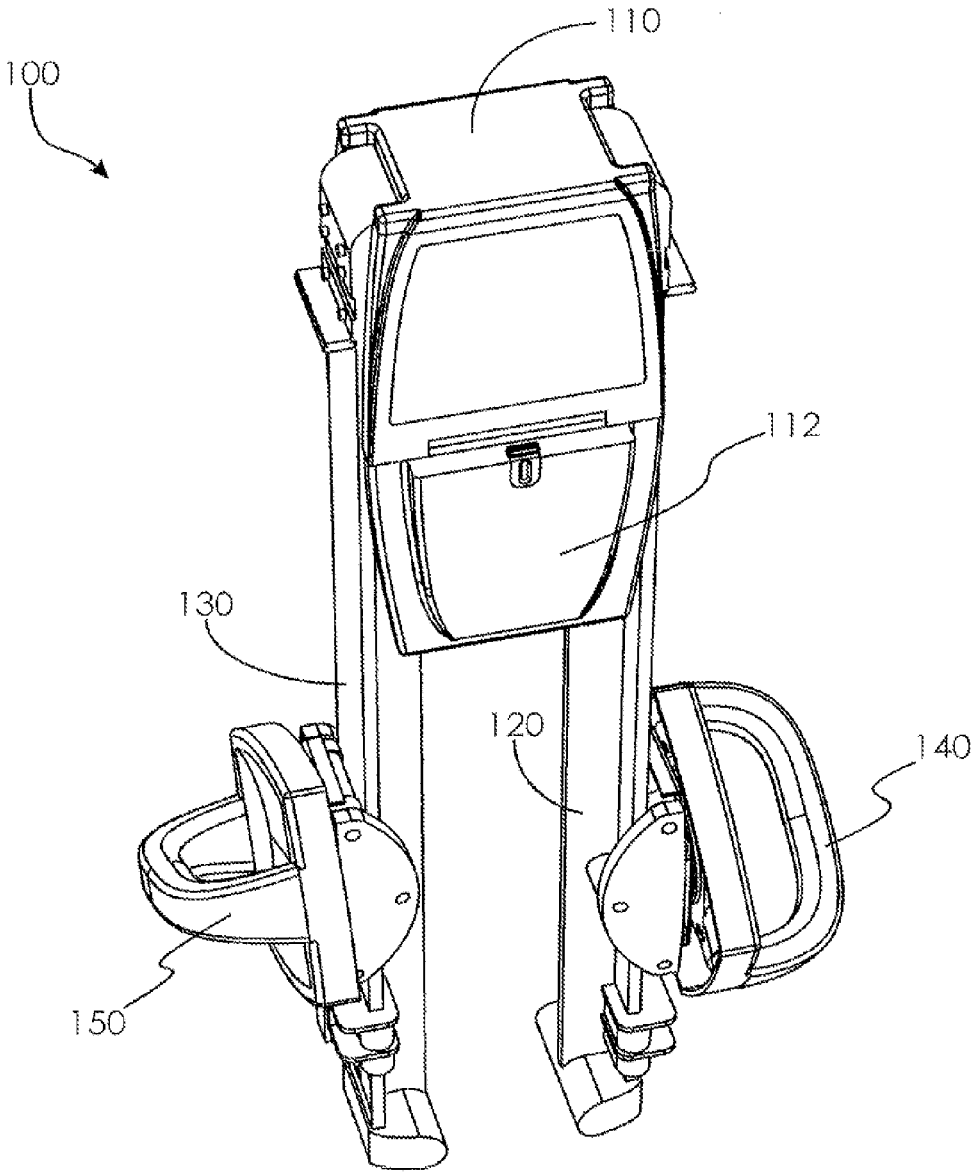
FIG. 5 shows the portable exercise apparatus of FIG. 1 in a storage configuration according to at least one embodiment of the present disclosure.

In FIG. 1, the base member 110 is shown including optional stabilization flaps 112. The stabilization flaps 112 provide greater stability to the apparatus 100, which may be particularly beneficial when an individual is using the apparatus 100. The stabilization flaps 112 may be configured to fold such that the flaps 112 can be in the configuration shown in FIG. 1 (laying flat on the ground), in a configuration where the flaps 112 are flat against the base member 110, or in a configuration where the flaps 112 lay flat away from the base member 110 (as shown in FIG. 5). Of course, this latter configuration may be beneficial when the user is storing or moving the apparatus 100. The stabilization flaps 112 may include a locking mechanism that allows a user to lock the flaps 112 in the use position (laying flat on the ground) shown in FIG. 1 and/or lock the flaps 112 in the storage/moving position (as shown in FIG. 5). The apparatus 100 may include various types of stabilization flaps or devices 112 that substantially increase the support footprint of the apparatus 100 beyond the base member 110 to provide greater stability. For example, FIG. 4*b* shows a stabilization flap 112 that substantially extends out from and surrounds the base member 110. The apparatus 100 may include one or more stabilization flaps 112 and each may be a different size and shape. While the flaps 112 described above are part of the base member 110, the flaps 112 may alternatively be attached or secured (e.g., rotatably) to the base member 100.

The first track 120 and second track 130 may typically be straight, elongate members with substantially T-shape cross-sections. Of course, the tracks 120, 130 may be other shapes and cross-sections, such as, for example, an elongate member with a square cross-section or an elongate member with one of the following cross-sections: I-shaped, U-shaped, C-shaped, and H-shaped. With a track that has a substantially T-shape cross-section, the apparatus 100 has a lower profile that promotes, among other things, stability. That is, with such a lower profile, the tracks 120, 130 can be closer to the ground because the handles 140, 150 do not need clearance space to pass underneath the track 120, 130 (which is the case for a track having a rectangular cross-section). The tracks 120, 130 may be various lengths, such as, for example, about twenty-three inches. The tracks 120, 130 may be various widths but are typically about the same width as the distance between the first wall FW and second wall SC of the base member 110. The tracks 120, 130 may be formed of various materials, including, but not limited to, metal, composites, plastic, and the like.

The tracks 120, 130 may be coupled to the base member 110 in a variety of ways. In an exemplary embodiment shown in FIG. 4*a*, the tracks 120, 130 of the apparatus 100 have first locking members 125 for coupling to the base member 110. Typically, first locking members 125 may be adjacent to an end of a track, such that the end of the particular track may be coupled to the base member 110. For example, as shown in FIG. 4*a*, the first track 120 has first locking members 125 at the second end 122 of the first track 120, and the second track 130 has first locking members 125 at the second end 132 of the second track 130. In FIG. 4*a*, the first locking members 125 comprise protrusions from the tracks 120, 130.

Figure 4F:
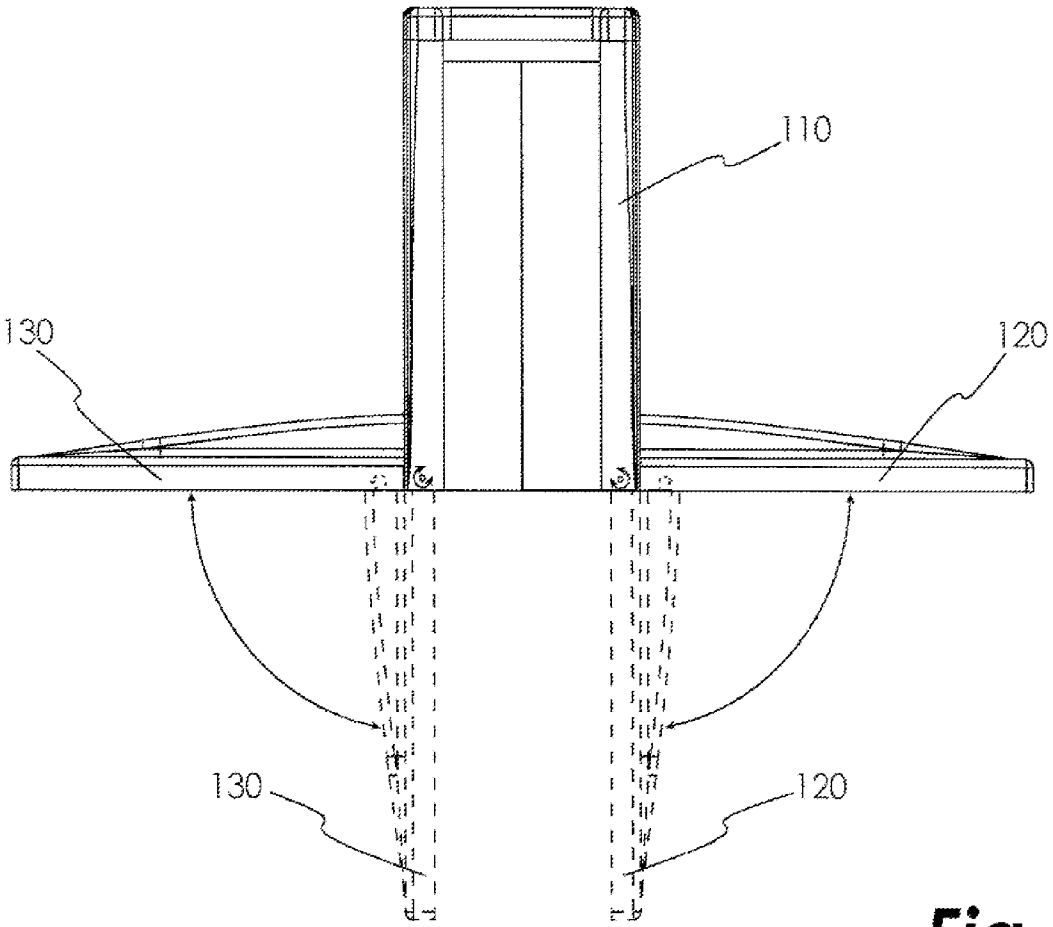
FIG. 4*f* shows an exercise apparatus in a use configuration and in a storage configuration according to at least one embodiment of the present disclosure.

As shown in FIG. 4*a*, the base member 110 may include second locking members 127*a*, 127*b*, 127*c* configured to receive or otherwise cooperate with corresponding first locking members 125 of the tracks 120, 130 to couple the tracks 120, 130 to the base member 110. The cooperation of first and second locking members 125, 127*a*, 127*b*, 127*c* illustratively couple base member 110 and tracks 120, 130 while permitting movement or rotation of tracks 120, 130 (e.g., as represented in FIG. 4*f*) and removability for adjustment of the tracks to different height levels as further described below. Illustratively, as shown in FIG. 4*a*, each second locking member 127*a*, 127*b*, 127*c* may be a groove cut or otherwise formed in each of the sides of each of first and second walls FW, SW. As shown in FIG. 4*e*, second locking members 127*a*, 127*b*, 127*c* may be formed on the inner surface of the walls FW, SW. In FIG. 4*a*, each second locking member 127*a*, 127*b*, 127*c* slopes away from the sides of each wall toward the center thereof, and down towards the ground when apparatus 100 is in the use position with the base number 110 against the ground. As shown in FIG. 4*a*, the first track 120 and second track 130 may be coupled to the base member 110 by fitting first locking members 125 of the first and second tracks 120, 130 within one of the second locking members 127*a*, 127*b*, 127*c* of the base member 110. The slope of the second locking members 127*a*, 127*b*, 127*c* down towards the ground makes it more difficult for the first locking members 125 of the tracks 120, 130 to escape from the grooves of the second locking members 127*a*, 127*b*, 127*c*. Of course, the second locking members 127*a*, 127*b*, 127*c* may include other features that substantially restrict the first locking members 125 from unintentionally becoming uncoupled from the base member 110. For example, as explained below, there may one or more lips that partially block the open end of the second locking members 127*a*, 127*b*, 127*c*.

Figure 4G:
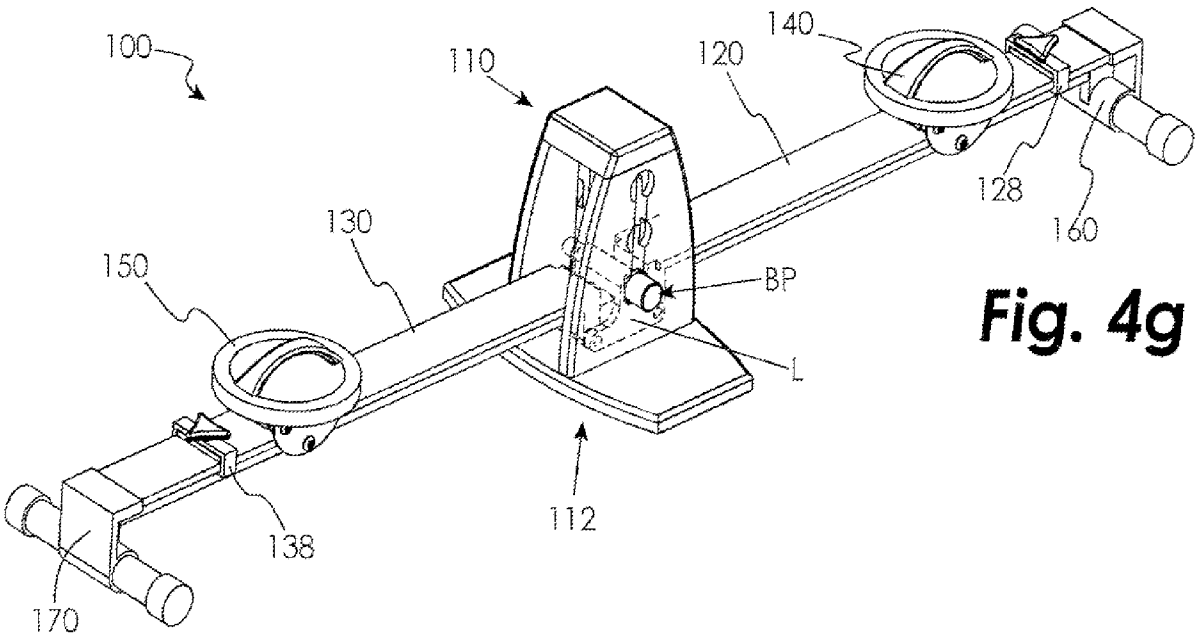
FIG. 4*g* shows an exercise apparatus with tracks coupled to the base member and the tracks being adjustable using a pin that interacts with a linking member, which connects the two tracks, such that movement of the linking member causes both of the tracks to move together according to at least one embodiment of the present disclosure.
Figure 4H:
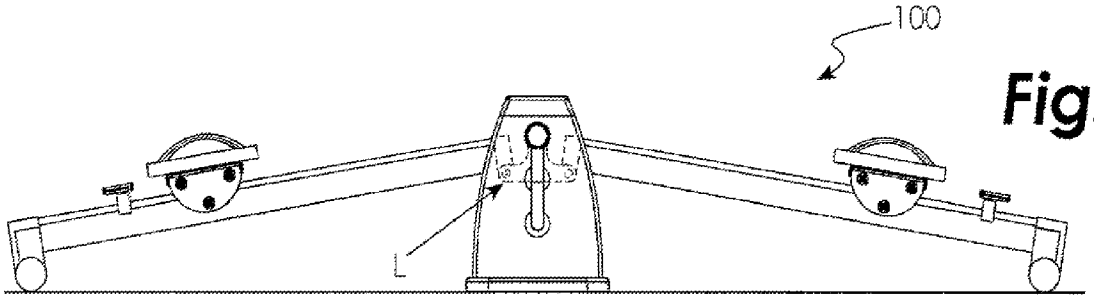
FIG. 4*h* shows the exercise apparatus of FIG. 4*g* in an inclined configuration according to at least one embodiment of the present disclosure.

In FIG. 4*a*, the base member 110 includes second locking members 127*a*, 127*b*, 127*c* at three different height levels along the base member 110. A user may adjust the incline angle of each track 120, 130 relative to the ground by fitting the first locking members 125 into one of the second locking members 127*a*, 127*b*, 127*c*. As shown in FIGS. 1 and 4*a*, the bottom second locking members 127*a* can be configured in the base member 110 such that when the tracks 120, 130 are locked to the base member 110 in the bottom second locking member 127*a*, the tracks 120, 130 are substantially parallel with the ground. The other second locking members 127*b*, 127*c* may be configured in the base member 110 such that when the tracks 120, 130 are locked to the base member 110 in the middle and top locking members 127*b*, 127*c*, the tracks 120, 130 may be inclined at various angles relative to the ground, such as, for example, five degrees and ten degrees. For example, FIGS. 2, 3, and 4*h* illustrate an apparatus having tracks configured in an inclined configuration. In one embodiment, the base member 110 may be adjustable so as to raise the portion of the base member 110 having the second locking members 127*a*, 127*b*, 127*c* to a greater height so as to increase the angle of incline of each of the tracks 120, 130 relative to the ground. Of course, a block or other device may be inserted below the base member 110 to raise the base member 110, as well.

In one embodiment, the tracks 120, 130 may be arranged in a declined configuration where the second ends 122, 132 of the tracks 120, 130 are closer to the ground compared to the first ends 121, 131 of the tracks 120, 130. The declined configuration may be accomplished by raising the height of the end supports 160, 170 (discussed below) or by inserting a block or other device under the end supports 160, 170 or first ends 121, 131 to prop up the first ends 121, 131 of the tracks 120, 130. The tracks 120, 130 may be set at various angles in the declined configuration, such as, for example, negative five degrees or negative ten degrees. With the tracks 120, 130 coupled to the base member 110, the apparatus 100 is effectively usable as a functionally unitary device. The ability to change the incline (or decline) of the tracks 120, 130 may provide a user with the ability to adjust the level of difficulty and/or to target different muscles or muscle areas.

The base member 110 may also include outer covers that can be attached or secured to walls FW, SW. As shown in FIG. 4*e*, the outer cover OC extends beyond the second locking members 127*a*, 127*b*, 127*c*. The outer cover OC may form one or more lips that extend away from the generally planar surface of the second wall SW toward the outer cover OC on the first wall FW. The outer cover OC of the first wall FW may have a similar lip. The lips of each outer cover OC may cooperate to at least partially retain the first locking members, and prevent the first and second tracks 120, 130 from being unintentionally separated from base member 110 but also allow for pivotable movement of the tracks 120, 130 relative to the base member 110 (like that shown in FIG. 4*f*). It is within the scope of this disclosure for outer covers OC to be integral with walls FW, SW forming a unitary structure.

Figure 4I:
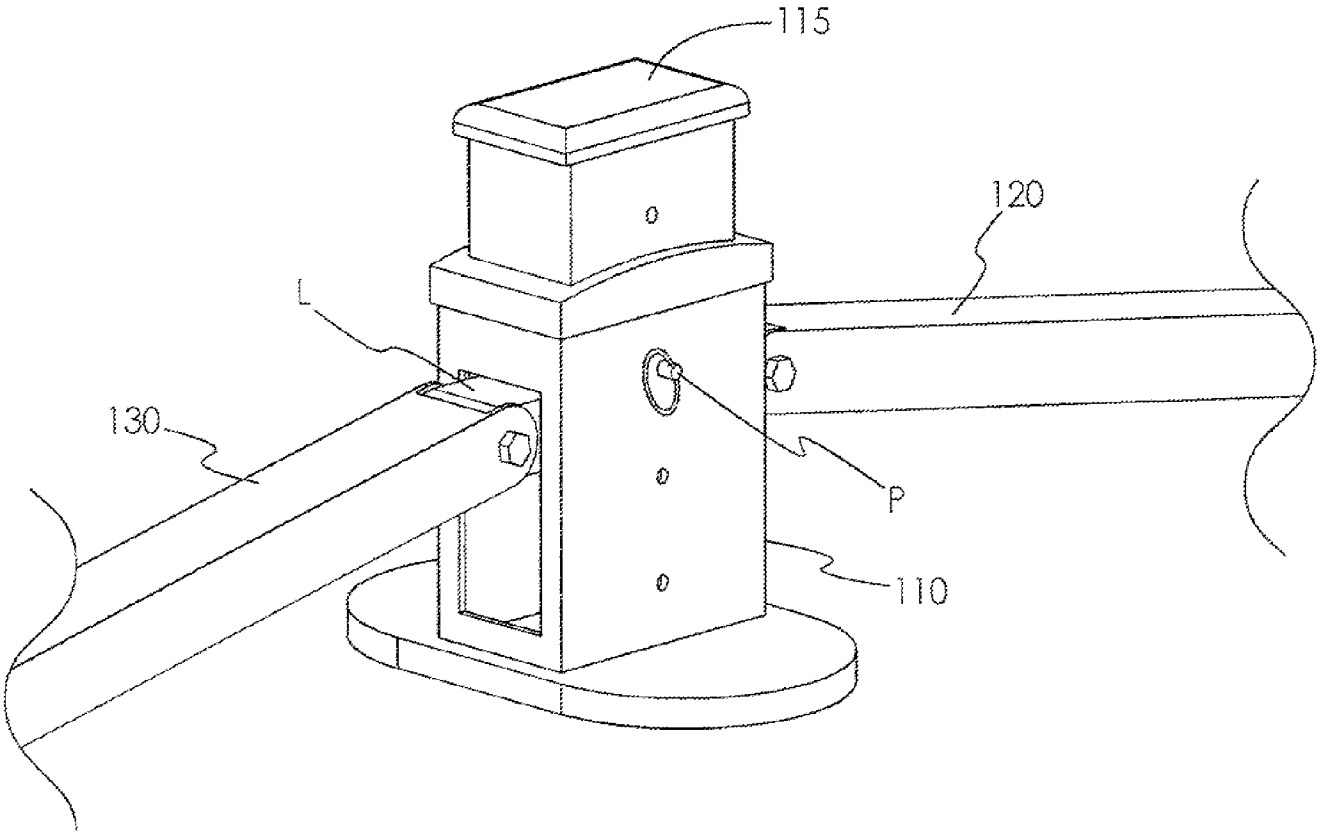
FIG. 4*i* shows a base member having an adjustable chest support according to at least one embodiment of the present disclosure.
Figure 4J:
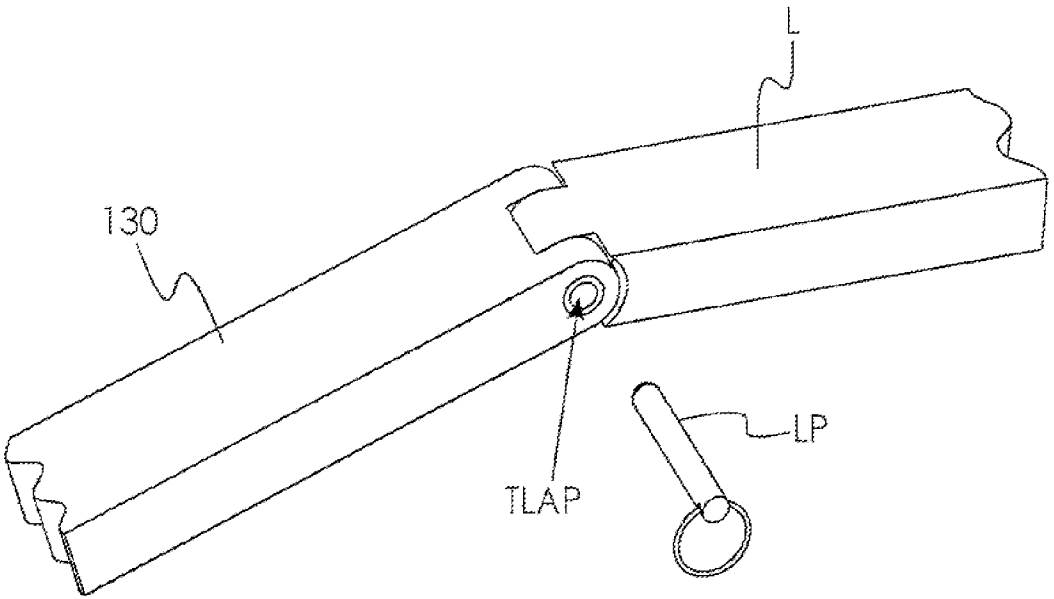
FIG. 4*j* shows a track mated with a link member defining a channel for receiving a pin according to at least one embodiment of the present disclosure.

While the discussion above of coupling the base member 110 with tracks 120, 130 was made in reference to various locking members, the tracks 120, 130 may alternatively be coupled to the base member 110 in various other ways. For example, one or more apertures or grooves in the tracks 120, 130 may be designed to receive one or more protrusions from the base member 110 in order to couple the tracks 120, 130 to the base member 110. Also, FIGS. 4*g*, 4*h*, and 4*i* depict embodiments of tracks 120, 130 coupled to the base member 110 where the tracks 120, 130 are attached to each other through a linking device L. FIG. 4*j* shows an exemplary embodiment of a track 130 and a linking device L configured to mate and define a chamber TLAP that is configured to receive a linking pin LP causing the track 130 and linking device L to couple together. As shown in FIGS. 4*g*, 4*h*, and 4*i* the tracks 120, 130 may be coupled to the base member 110 using a base pin BP (but may use other attachment mechanisms) to couple the tracks to the base member 110 at various positions. For apparatuses 100 where the tracks 120, 130 are coupled to one another (as in FIGS. 4*g*, 4*h*, and 4*i*), a user may be able to adjust the positioning of both of the tracks 120, 130 relative to the base member through manipulation of the base pin BP (or knob or other attachment mechanism). While the base pin P (or other attachment mechanism) described above can be manipulated by a user, a computer, mechanical system, or other technological system may be used to perform the manipulation to adjust the position of the tracks 120, 130 relative to the base member 110, such as, for example, to achieve a particular incline or decline for the tracks 120, 130 relative to the ground. It should also be noted that a computer, mechanical system, or other technological system may adjust the tracks 120, 130 without a pin P (or other attachment mechanism).

As shown in FIGS. 4*f* and 5, in at least one embodiment, the tracks 120, 130 may be coupled to the base member 110 in a manner where the tracks 120, 130 can be rotated or folded about the base member 110. With such a configuration, the apparatus 100 may be folded for transport or storage.

Figure 6:
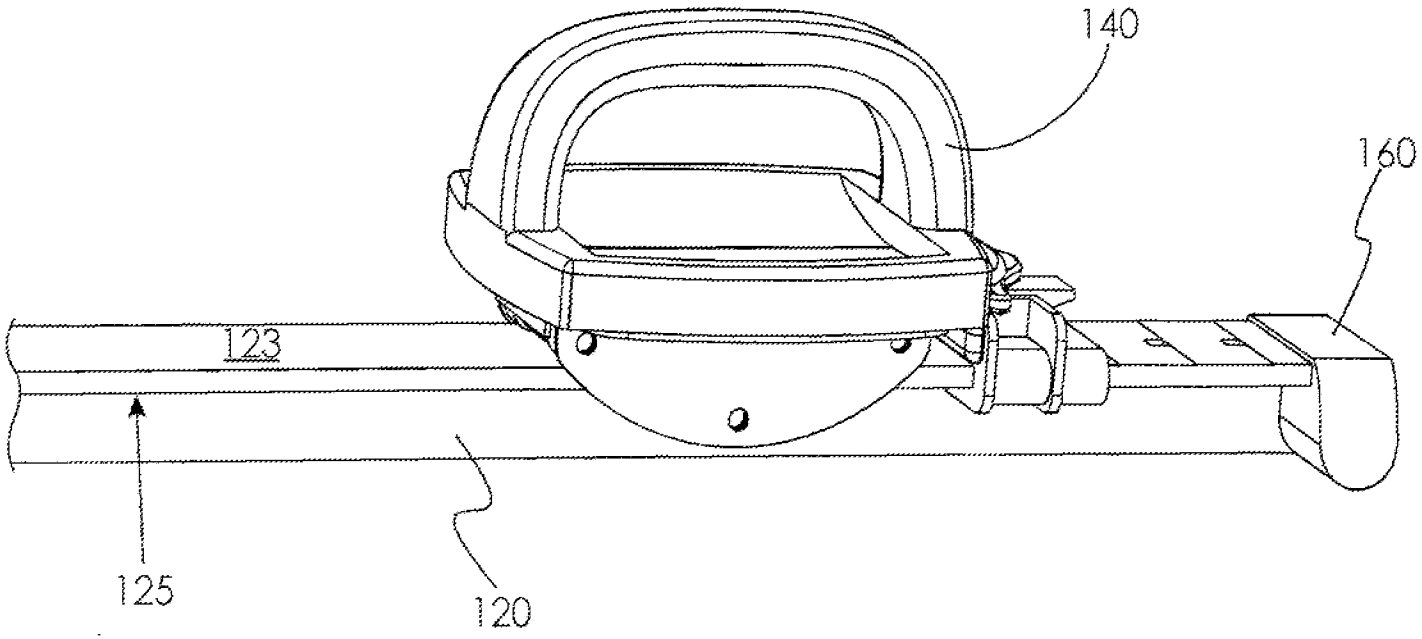
FIG. 6 shows a magnified view of the first handle of the portable exercise apparatus of FIG. 1 according to at least one embodiment of the present disclosure.
Figure 7A:
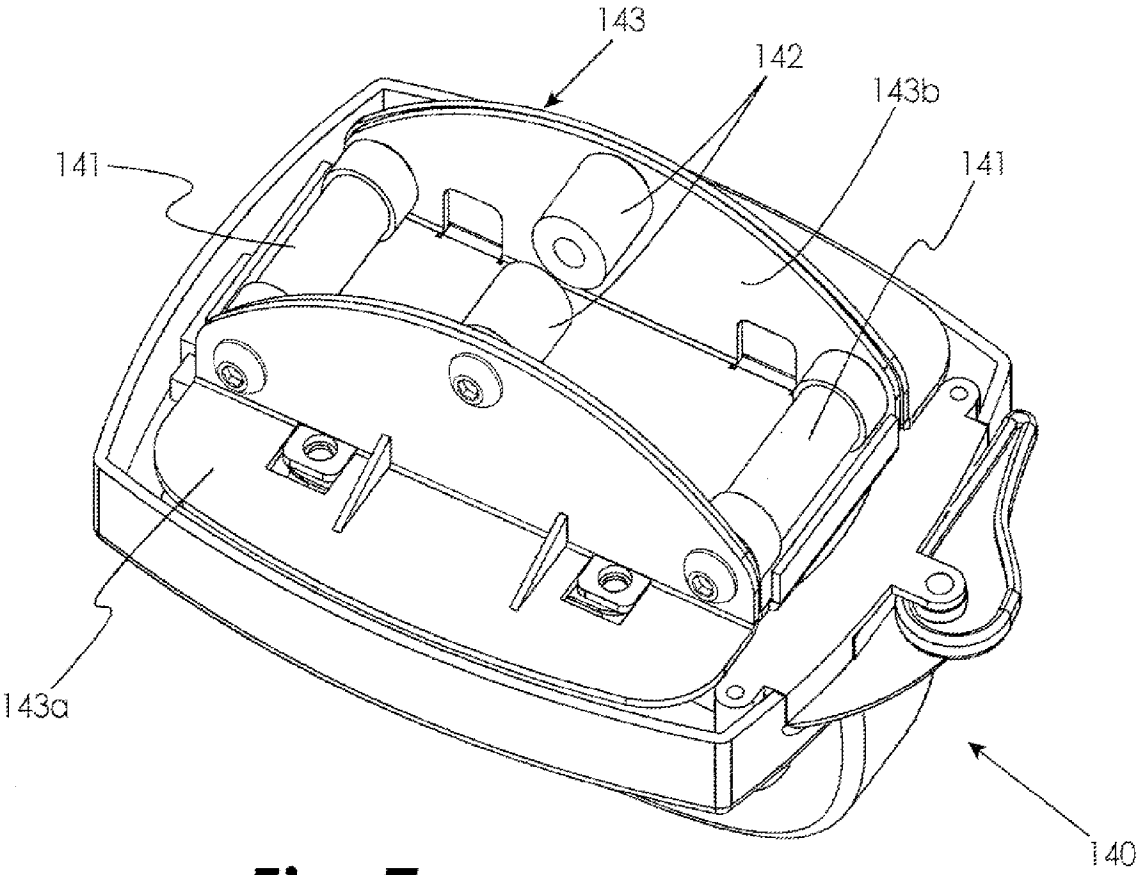
FIG. 7*a* shows a perspective illustration of the bottom side of the first handle of FIG. 6 according to at least one embodiment of the present disclosure.

As shown in FIG. 1, the apparatus 100 also includes a first handle 140 and a second handle 150 coupled to the first track 120 and second track 130, respectively, such that the handles 140, 150 can move (e.g., glide) along the corresponding tracks 120, 130. FIG. 6 shows a magnified view of the first handle 140 coupled to the first track 120. FIG. 7*a* shows a perspective view of the bottom side of the first handle 140 in FIG. 6. In FIG. 7*a*, the first handle 140 includes first members 141, second members 142, and a support system 143 for securing the first handle 140 to the first track 120. In FIG. 7*a*, the support system 143 includes first support portion 143*a* and second support portion 143*b* that, when the first handle 140 is in use on the first track 120, extend towards the ground. The first and second members 141, 142 may be attached to or integral with the support system 143. The first and second members 141, 142 may be attached to the support system 143 in various ways, such as, for example, using screws, bolts, and glue. In at least one embodiment, the first and second members 141, 142 are attached to the support system 143 such that they are permitted to roll about their longitudinal axis.

Figure 7B:
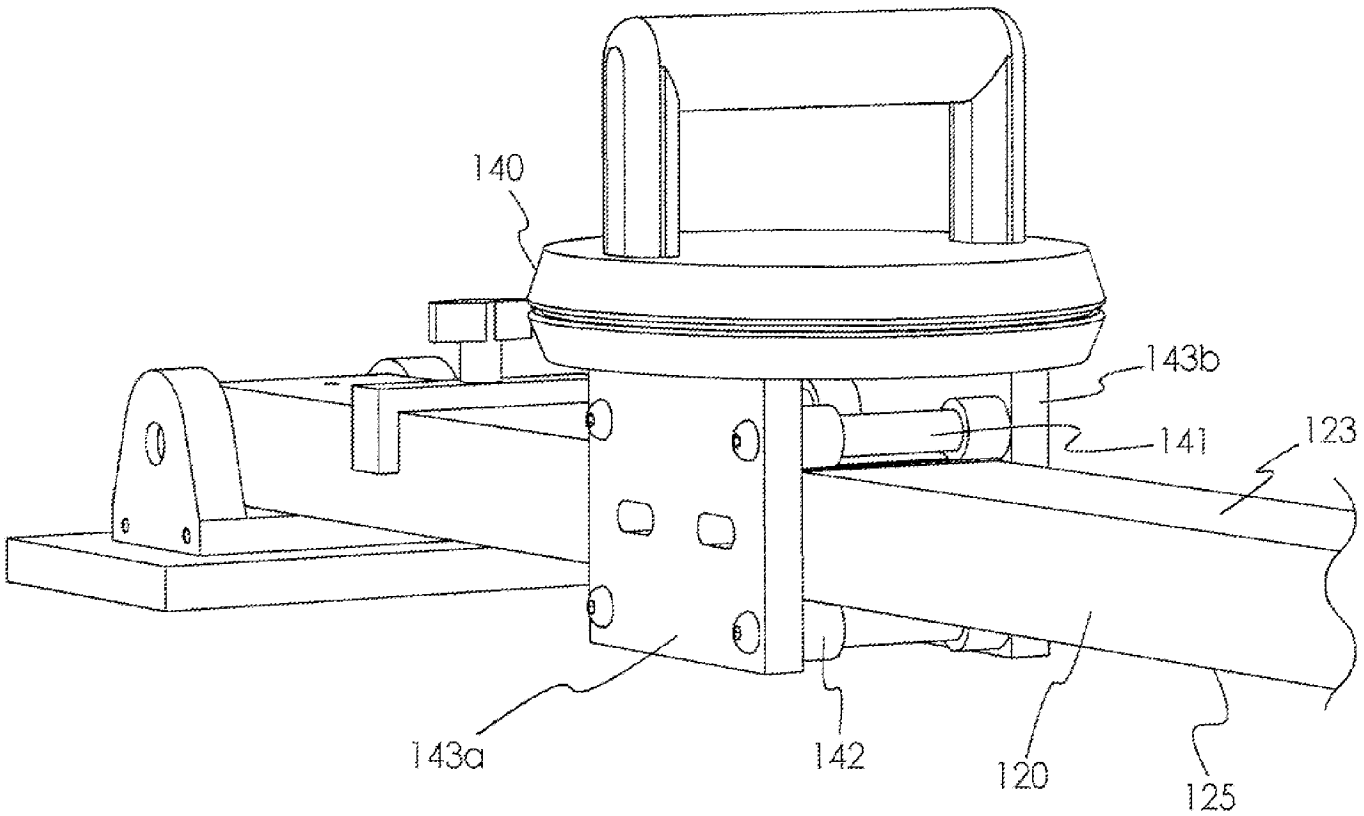
FIG. 7*b* shows a perspective view of a handle coupled to a track according to at least one embodiment of the present disclosure.
Figure 7C:
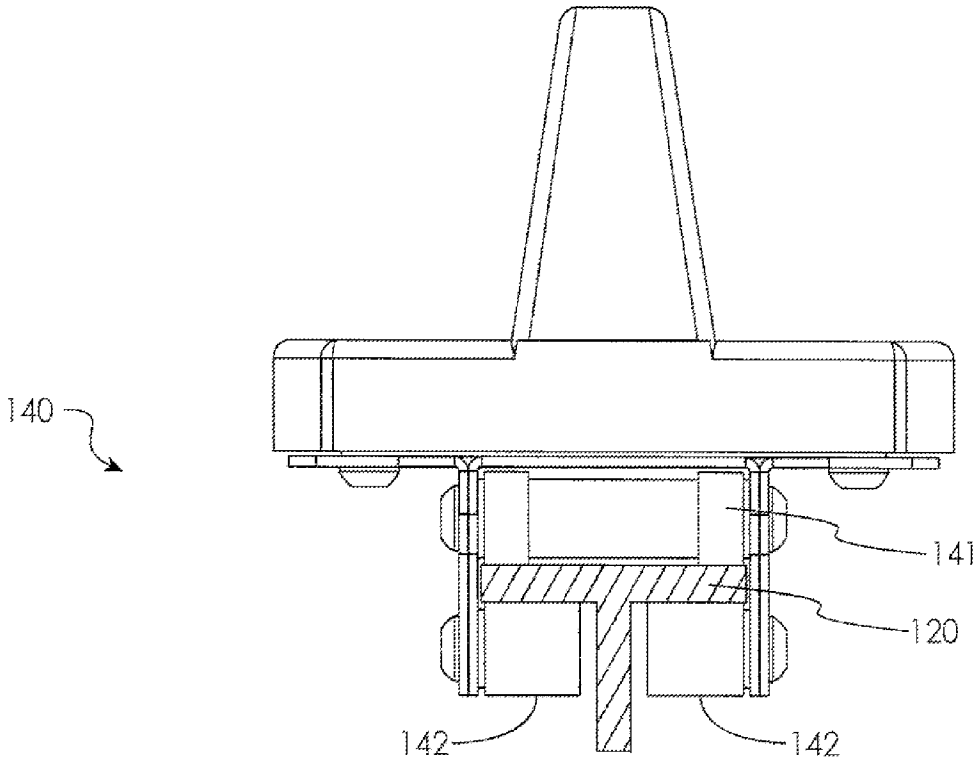
FIG. 7*c* shows a cross-section view of the support portions of a handle slidably coupled to a substantially T-shaped track where rollers are shown in contact with the track according to at least one embodiment of the present disclosure.
Figure 7D:
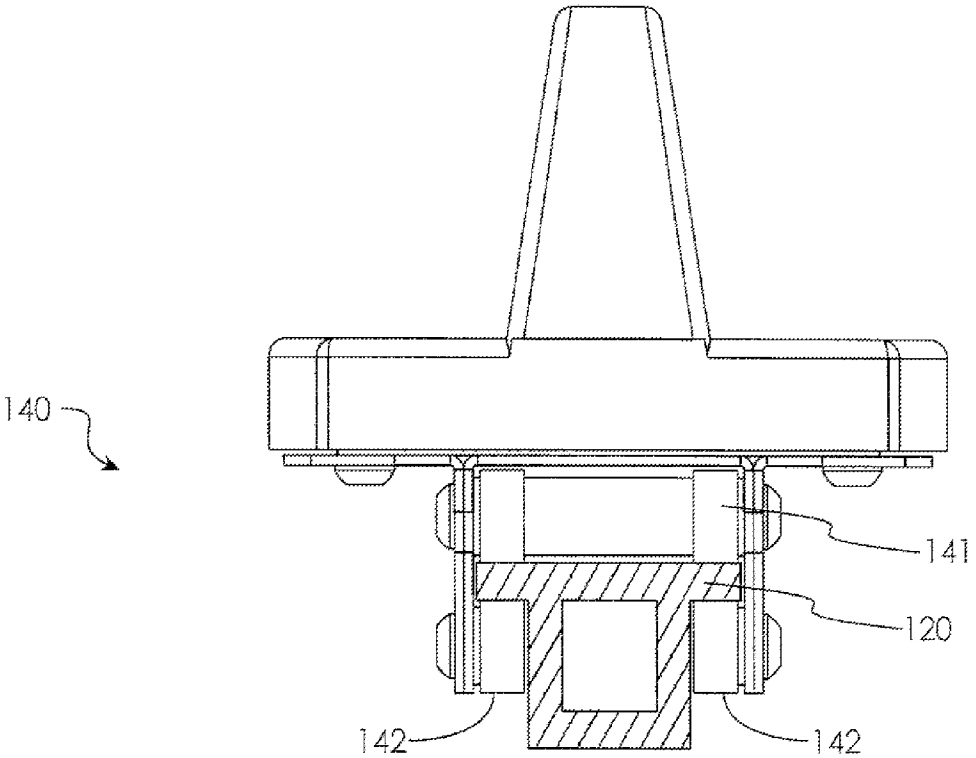
FIG. 7*d* shows a cross-section view of the support portions of a handle coupled to a track having a substantially T-shaped cross-section according to at least one embodiment of the present disclosure.
Figure 7E:
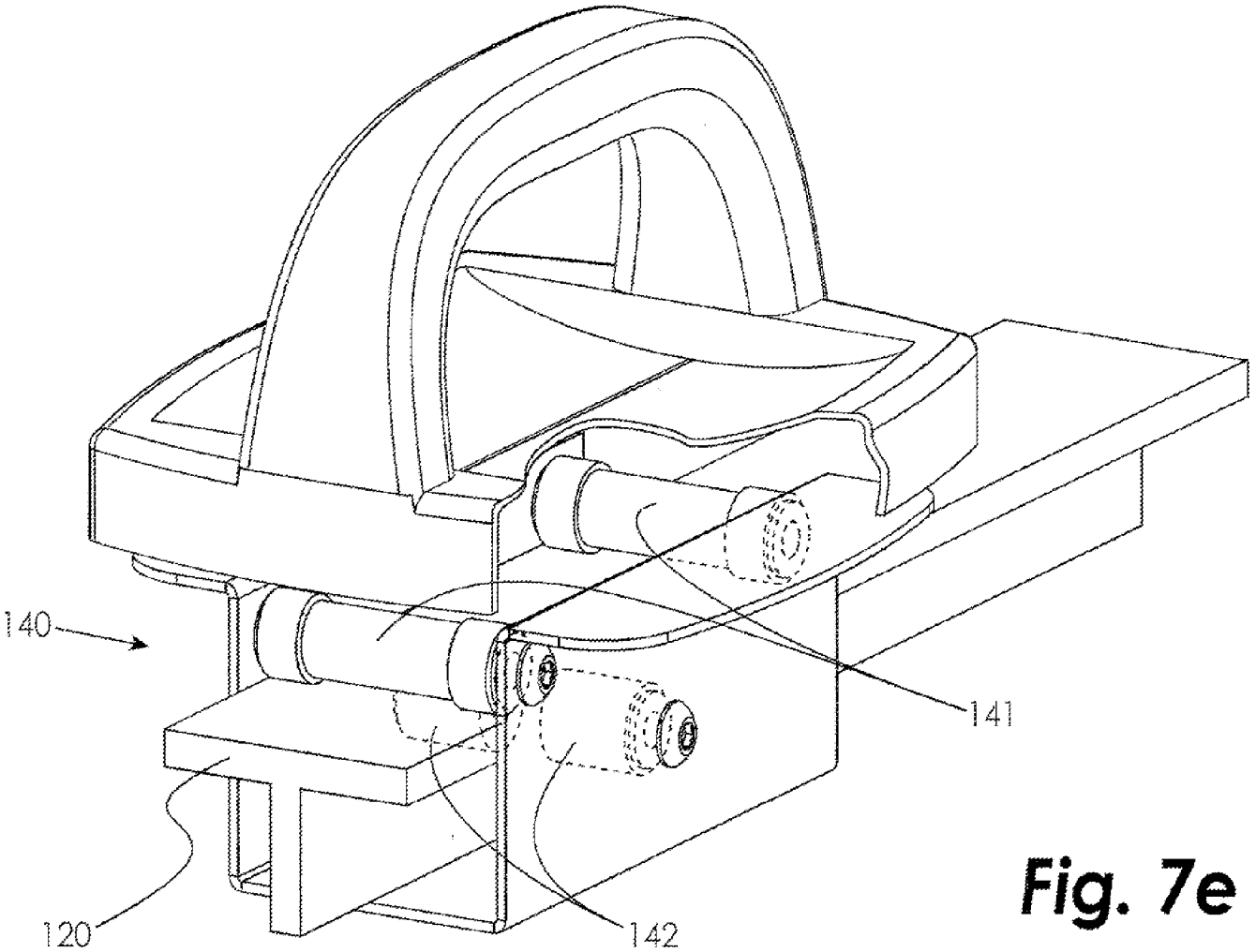
FIG. 7*e* shows a perspective view of the support portions of a handle coupled to a track having a substantially T-shaped cross-section according to at least one embodiment of the present disclosure.
Figure 7F:
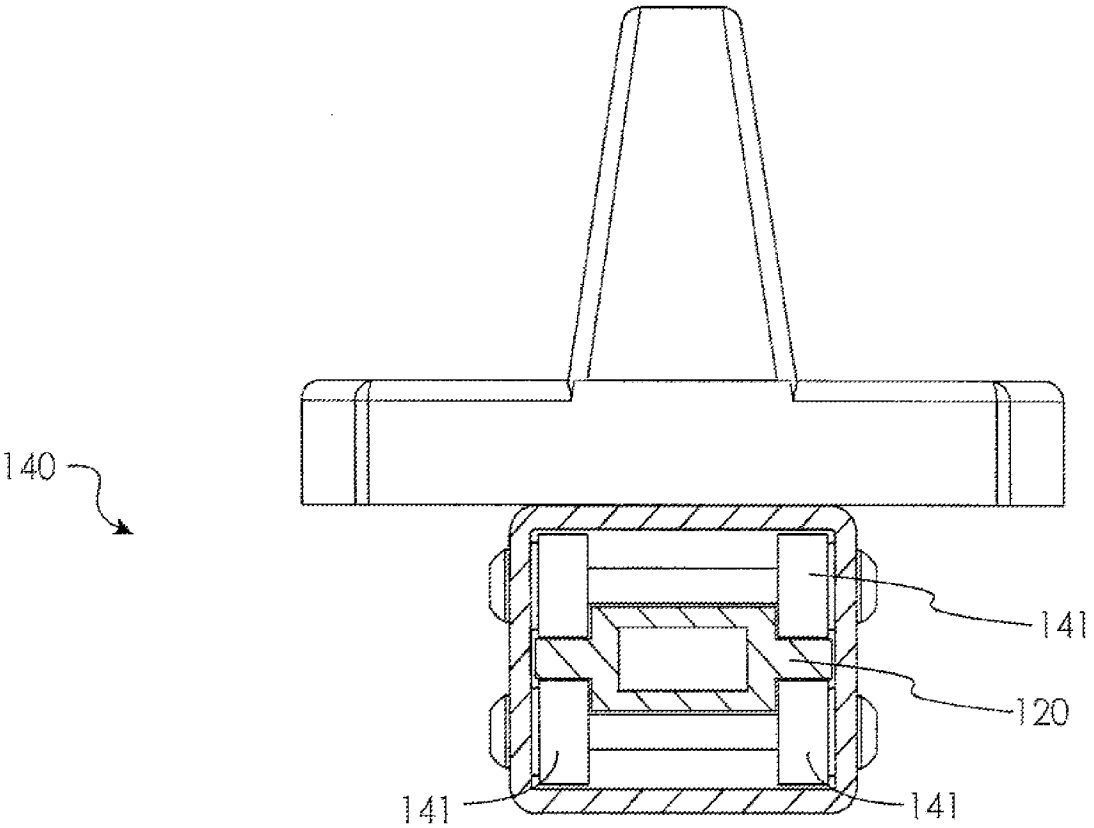
FIG. 7*f* shows the support portions of a handle coupled to a track having a rectangular box-shaped track according to at least one embodiment of the present disclosure.
Figure 7G:
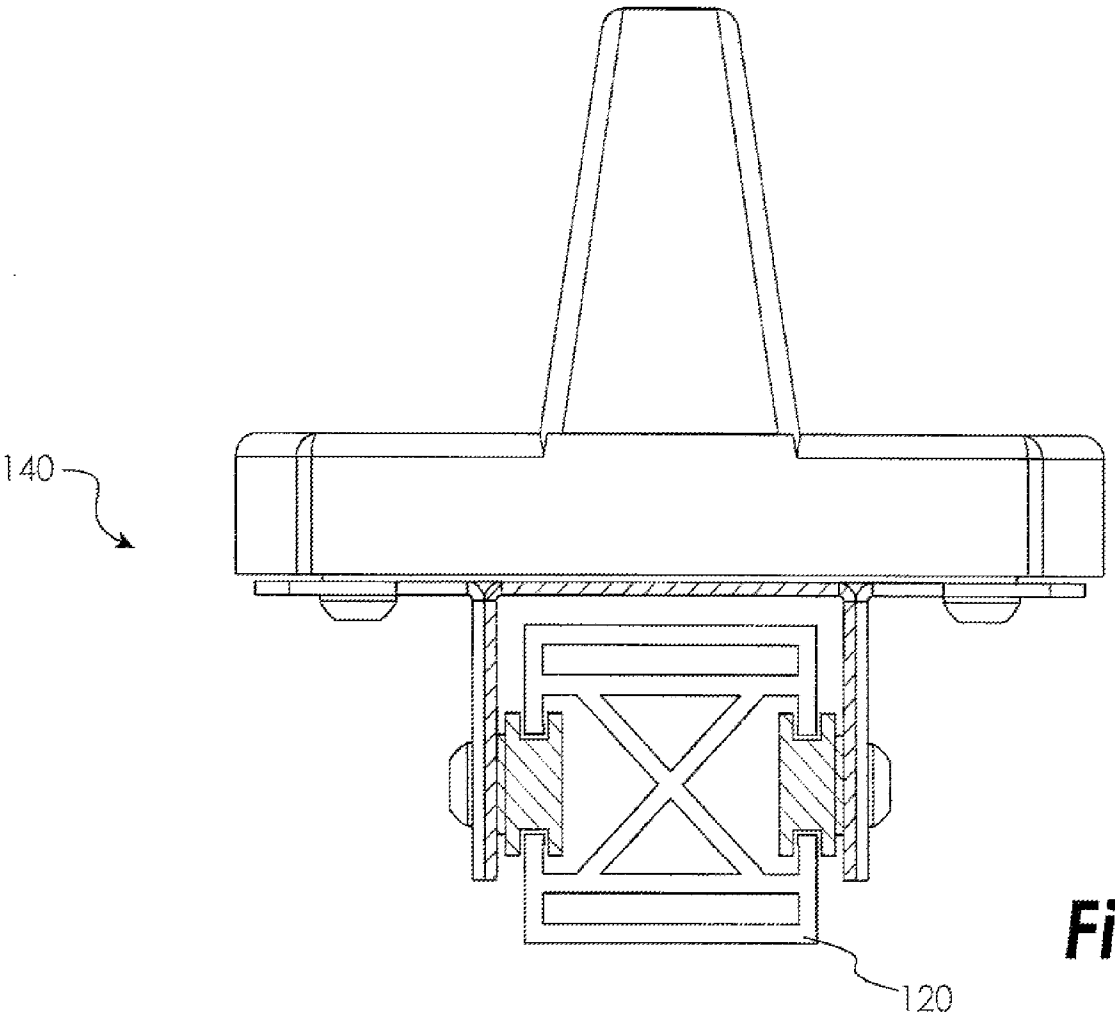
FIG. 7*g* shows a cross-section of a portion of the support portions of a handle coupled to a track having a substantially square-shaped cross-section according to at least one embodiment of the present disclosure.

FIG. 7*b* shows a perspective view of one embodiment of a handle 140 coupled to the first track 120, where the first track 120 has a substantially square cross-section. In FIG. 7*b*, the first member 141 and second member 142 of the handle 140 extend between the first support portion 143*a* and the second support portion 143*b*. The first members 141 may be configured such that when the first handle 140 is coupled to the first track 120 (as shown in FIG. 7*b*), the first members 141 are adjacent to or in contact with the top surface 123 of the first track 120. The first members 141 may be configured to roll as the user moves the first handle 140 along the first track 120. Of course, the first members 141 may simply slide along the top surface 123 of the first track 120. The second members 142 are configured such that when the first handle 140 is coupled to the first track 120 (as shown in FIG. 7*b*), the second members 141 are adjacent to or in contact with the underside surface 125 of the first track 120. As with the first members 141, the second members 142 may be configured to roll or simply slide along the underside surface 125 of the first track 120. Of course, the description above regarding the first handle 140 may also be applied to second handle 150. It should be noted that the handles 140, 150 may have various other configurations that effectively couple the handles 140, 150 to respective tracks 120, 130 and permit the handles 140, 150 to rotate, slide, move, glide, or otherwise move along the tracks 120, 130.

As illustrated in FIGS. 7*c*-7*g*, the first members 141, second members 142, and support systems 143 for securing a handle 140, 150 to a track 120, 130 (of a particular cross-section) may be various configurations and designs that are configured in such a way that the handle 140, 150 is movable along the corresponding track 120, 130.

Figure 8A:
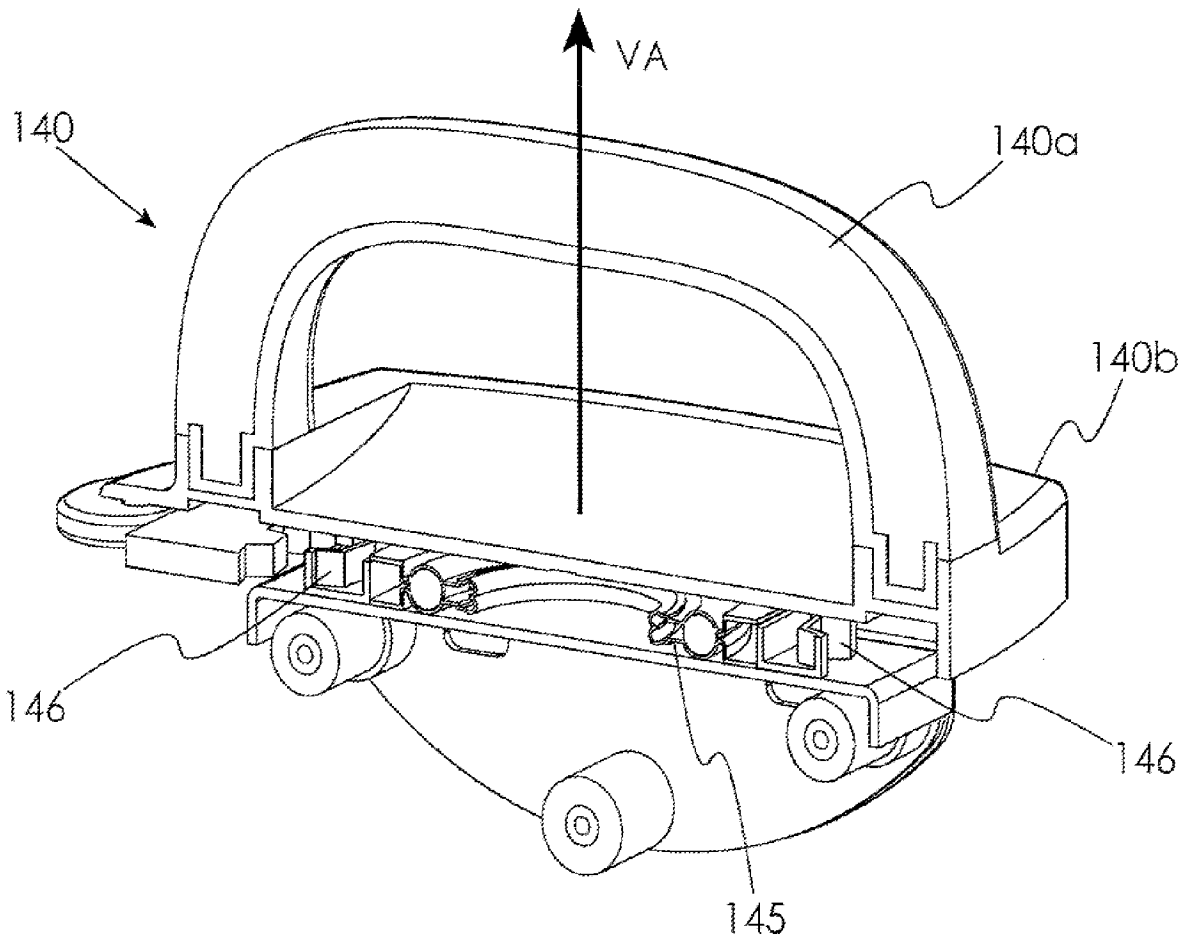
FIG. 8*a* shows an illustration of a cross-section view of the handle 140 of FIG. 6 taken along the grip according to at least one embodiment of the present disclosure.
Figure 8B:
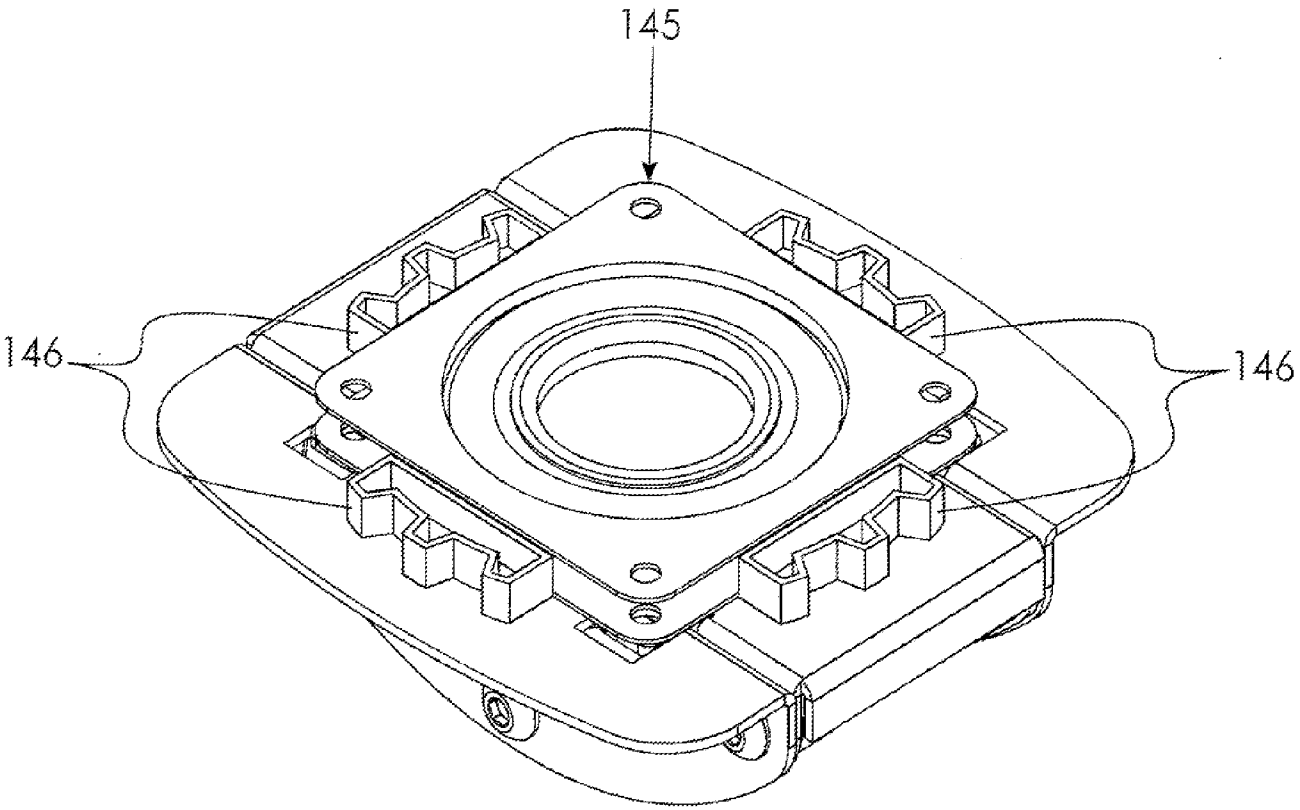
FIG. 8*b* shows a perspective illustration of a turntable device according to at least one embodiment of the present disclosure.
Figure 8C:
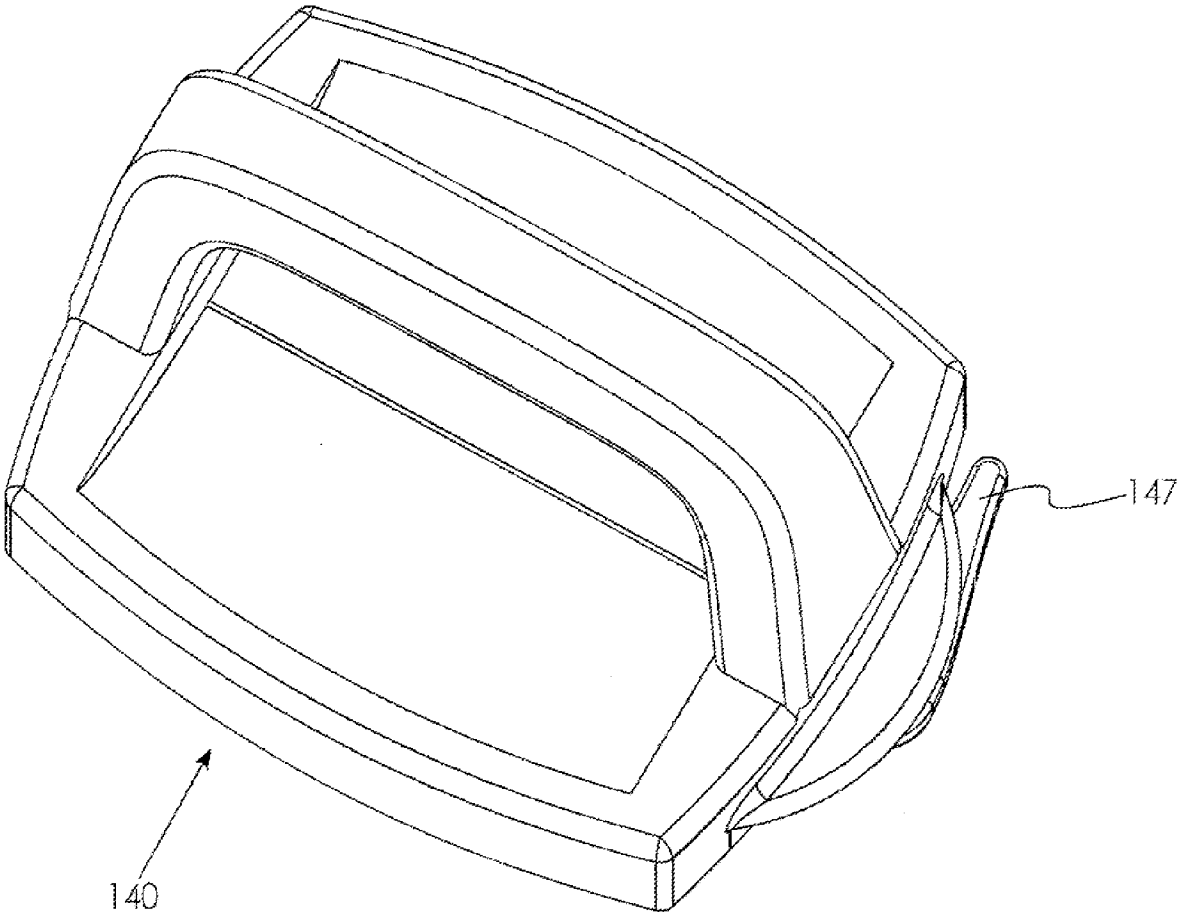
FIG. 8*c* shows an illustration of a handle with a locking system according to at least one embodiment of the present disclosure.

In one embodiment, a portion of one or both of the handles 140, 150 may be configured to rotate in place about the respective handles 140, 150 own vertical axis when apparatus 100 is in the use position shown in FIG. 1. The ability of a portion of one or both handles 140, 150 to rotate about its own vertical axis may accommodate a user's preferred hand and arm orientation or the natural movement of a user's body when exercising and moving the handles 140, 150 along the tracks 120, 130. FIG. 8*a* shows a sectional view of the first handle 140 in FIG. 6 along the length of the grip 140*a*. In FIG. 8*a*, the first handle 140 includes a turntable device 145. The turntable device 145 is designed such that the grip 140*a*, handle platform 140*b*, and other portions of the first handle 140 attached (directly or indirectly) to the top side of the turntable device 145 are permitted to rotate about vertical axis VA while other portions of the first handle 140 that are attached (directly or indirectly) to the bottom side of the turntable device 145 (e.g., first beams 141 and second beams 142) remain stationary. FIG. 8*b* shows an example of a turntable device 145 that may be implemented in a handle 140, 150 to provide rotation for a portion of the handle 140, 150. As shown in FIGS. 8*a* and 8*b*, the first handle 140 may also include turntable locks 146, which may be engaged to restrict the rotation of the grip 140*a* via the turntable device 145. As shown in FIG. 8*c*, the handle 140 can include a lever 147 that can engage or disengage turntable locks 146 against the turntable device 145. It should be noted that the handles 140, 150 may not include a turntable device 145 at all. In other words, the handles 140, 150 may not be rotatable, just movable or slidable along the track 120, 130.

Figure 8D:
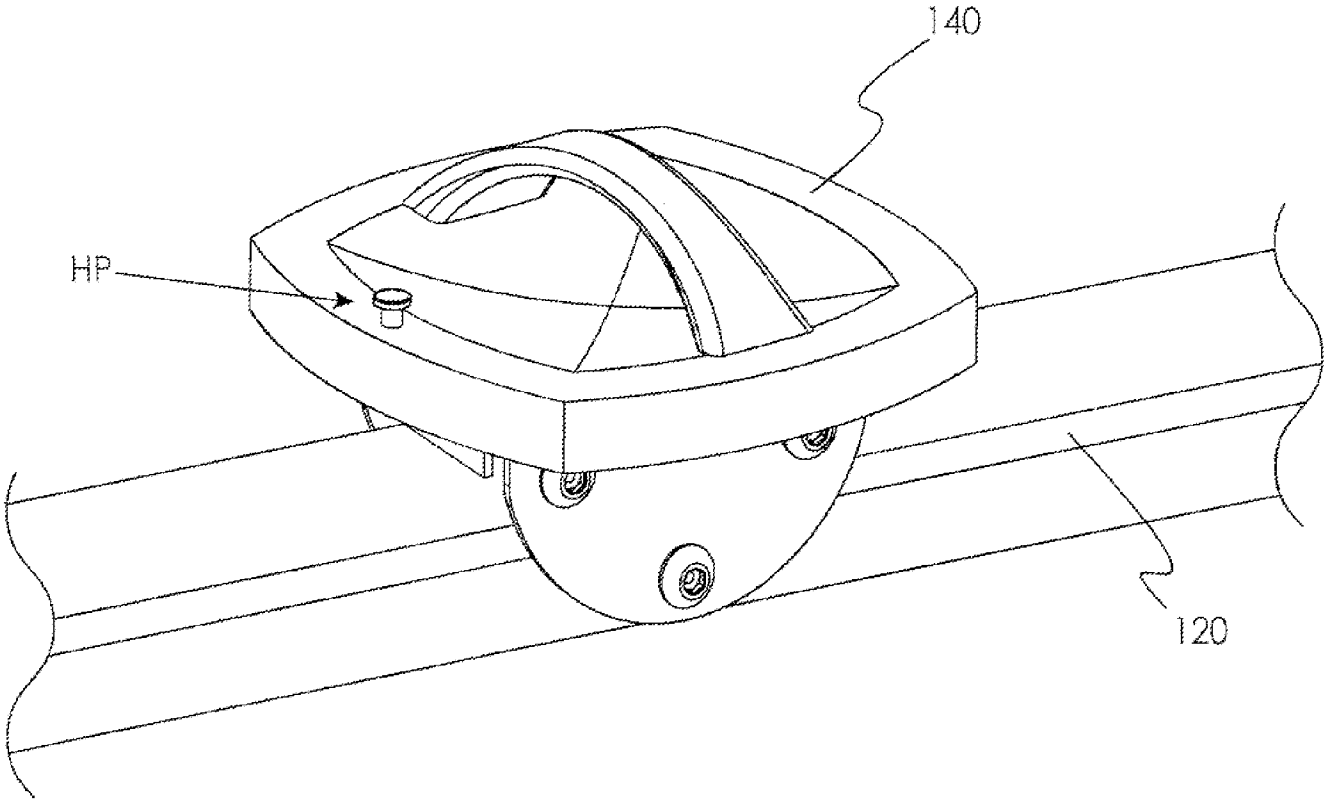
FIG. 8*d* shows a handle coupled to a track, where the handle includes a pin lock that is configured to lock the handle in place on the track according to at least one embodiment of the present disclosure.

It should also be noted that the handles 140, 150 may be configured to lock themselves at one spot on the respective tracks 120, 130. For example, FIG. 8*d* shows a handle 140 that includes a handle pin HP that is configured to lock the handle 140 in place on the track 120, such as, for example, inserting the handle pin HP into an aperture in the track 120 or forcing the handle pin HP against the surface of the track 120. In at least one embodiment, at least one of the handles 140, 150 may be configured to be articulating, such as, for example, by utilizing one or more springs between a grip portion of the handle 140, 150 and the other portion of the handle 140, 150.

Figure 9A:
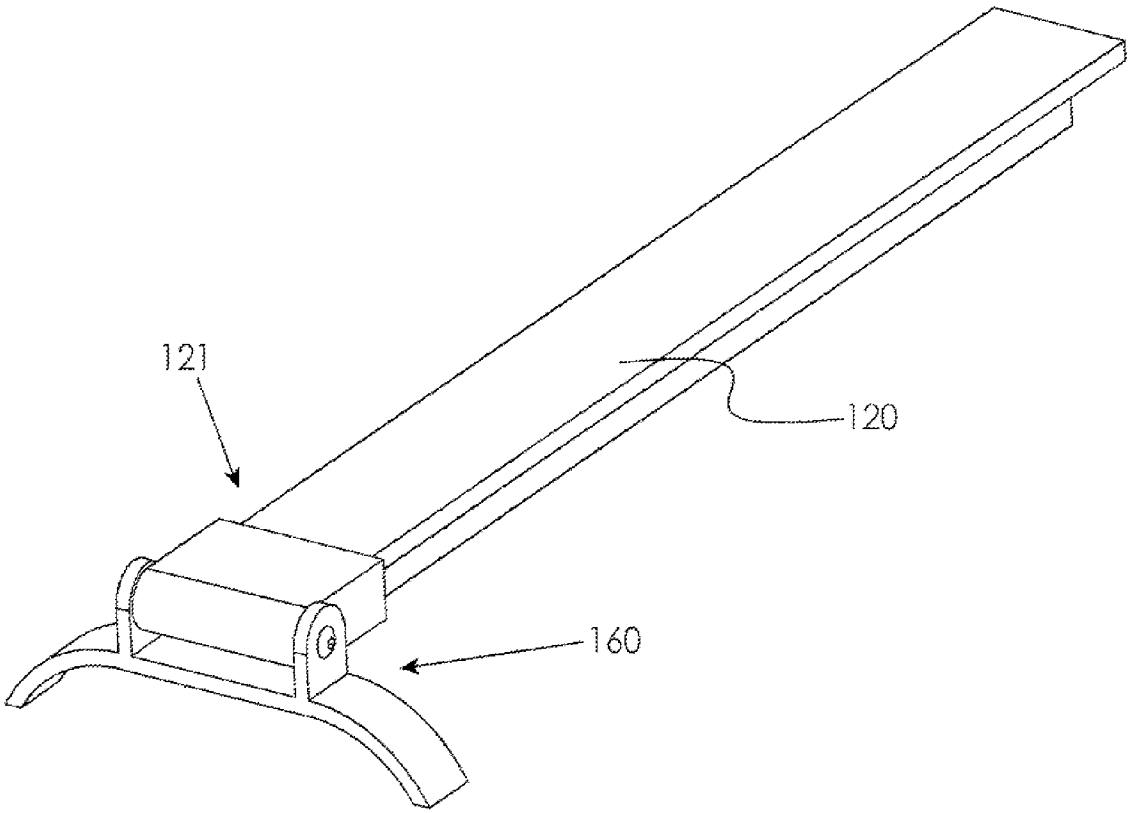
FIG. 9*a* shows an end support attached to a track where the end support has a wide base according to at least one embodiment of the present disclosure.
Figure 9B:
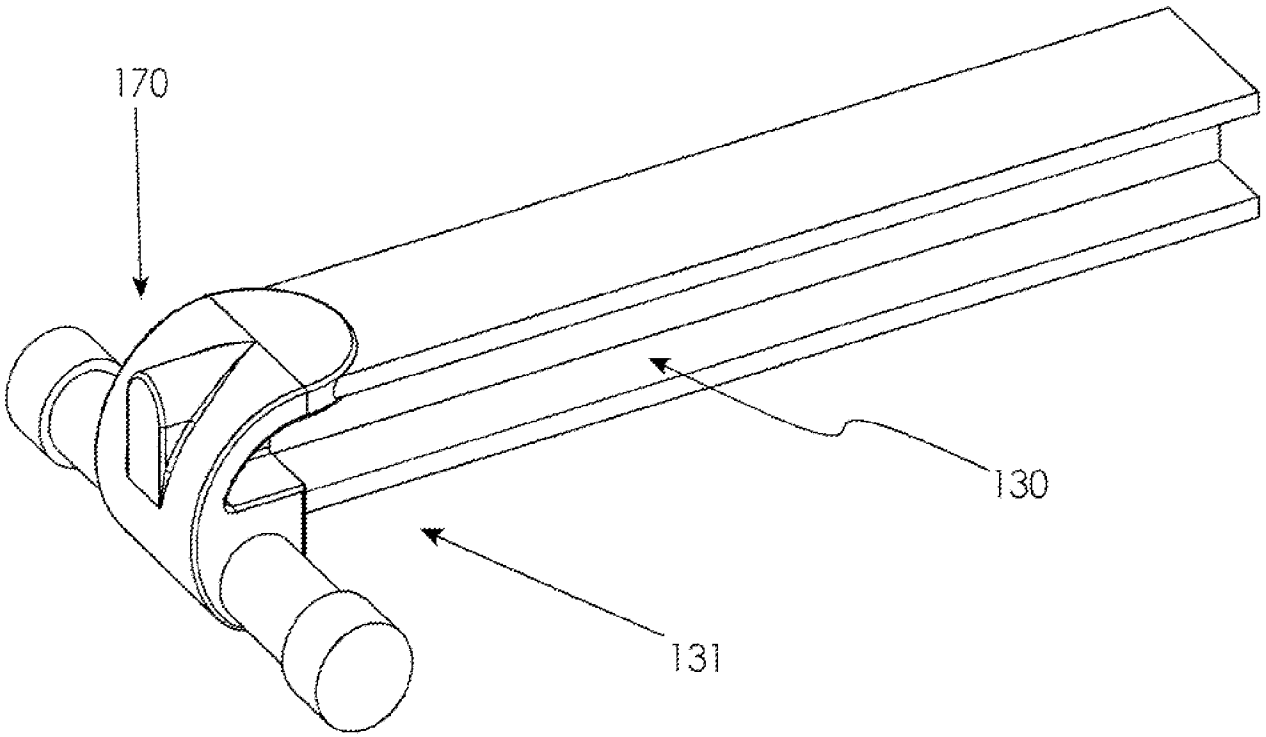
FIG. 9*b* shows an end support attached to a track according to at least one embodiment of the present disclosure.

As shown in FIG. 1, the apparatus 100 may also include a first end support 160 and a second end support 170. While the remainder of this discussion describes the end supports 160, 170 as being separate from the tracks 120, 130, it should be noted that the end supports 160, 170 may be integral with or part of the tracks 120, 130. In FIG. 1, the first end support 160 is shown attached to the first end 121 of the first track 120, and the second end support 170 is shown attached to the first end 131 of the second track 130. The end supports 160, 170 may be attached to the first ends 121, 131 in various ways, such as, for example, using nuts and bolts. FIGS. 9*a* and 9*b* illustrate embodiments of end supports 160, 170. As shown in FIGS. 9*a*-9*b*, end supports 160, 170 may be pivotably attached or substantially immovably attached to a track 120, 130. The surface area of an end support 160, 170 that actually touches the ground may vary depending upon the surface upon which the apparatus 100 is used. For example, FIG. 9*a* shows an end component 160, 170 that may typically be used for a carpet surface because it has a relatively small surface area that contacts the carpet, while FIG. 9*b* shows a component 160, 170 that may be used for a smooth surface because it has a relatively large surface area that contacts the ground. In at least one embodiment, an end component 160, 170 may include one or more wheels.

As shown in FIG. 1, the end supports 160, 170 can elevate the first ends 121, 131 of tracks 120, 130 above the ground. As a result, when the tracks 120, 130 are attached to the base member 110, the tracks 120, 130 may be suspended above the ground as shown, for example, in FIGS. 1 and 2. Such suspension of the tracks 120, 130 above the ground may allow the handles 140, 150 to move or glide along the tracks 120, 130, particularly if the handles 140, 150 require clearance space underneath the tracks 120, 130 to be able to move or glide. Of course, if the handles 140, 150 are not designed to surround the respective tracks 120, 130 and do not need clearance space underneath the tracks 120, 130 to be able to move or glide, then the tracks 120, 130 may sit on or just above the ground. The portion of the end supports 160, 170 that contacts the ground may be formed of a variety of materials, such as, for example, materials that resist movement like rubber or a tacky material. Such resistance of movement by the end supports 160, 170 may be beneficial, particularly to resist the forces generated by the user while performing push-ups with the apparatus 100. The end supports 160, 170 may be configured to limit or eliminate scratching or otherwise harming the ground or floor upon which the apparatus 100 is used.

Figure 10A:
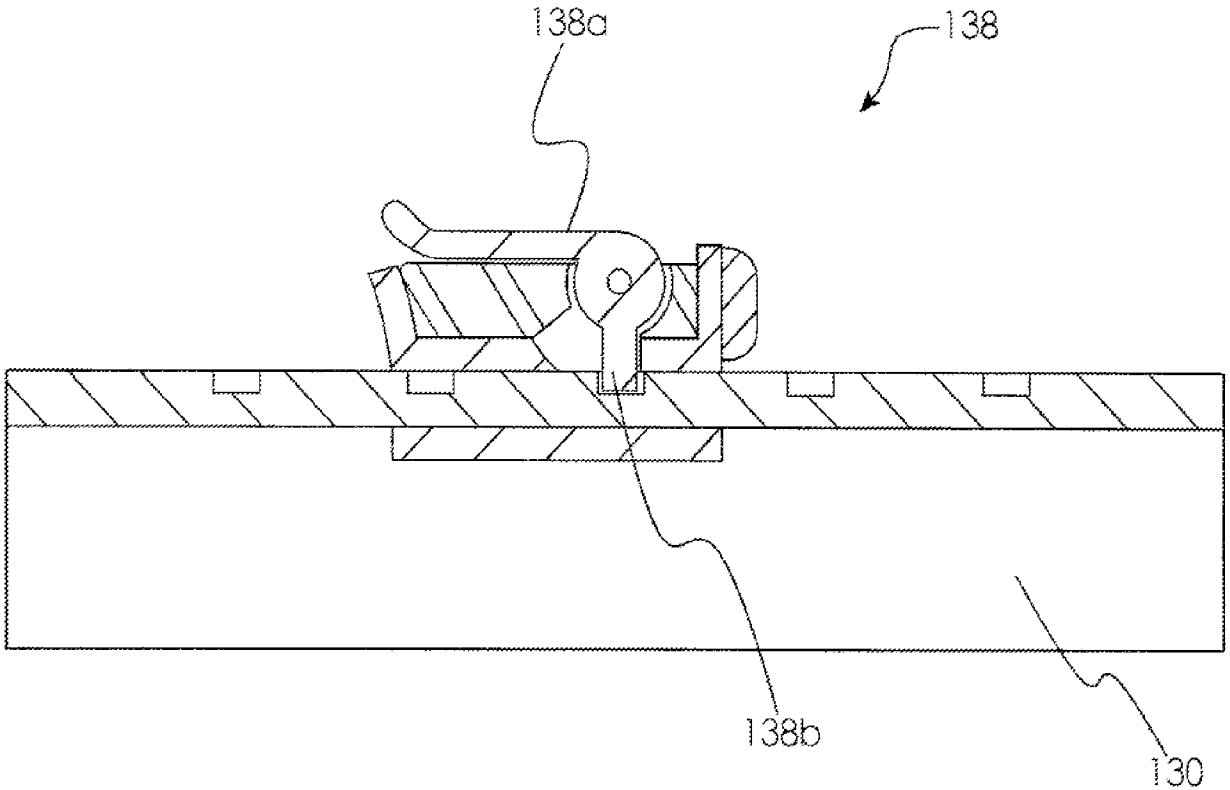
FIG. 10*a* shows a stopper on a track having a substantially T-shaped cross-section where the stopper includes a cam lever according to at least one embodiment of the present disclosure.
Figure 10B:
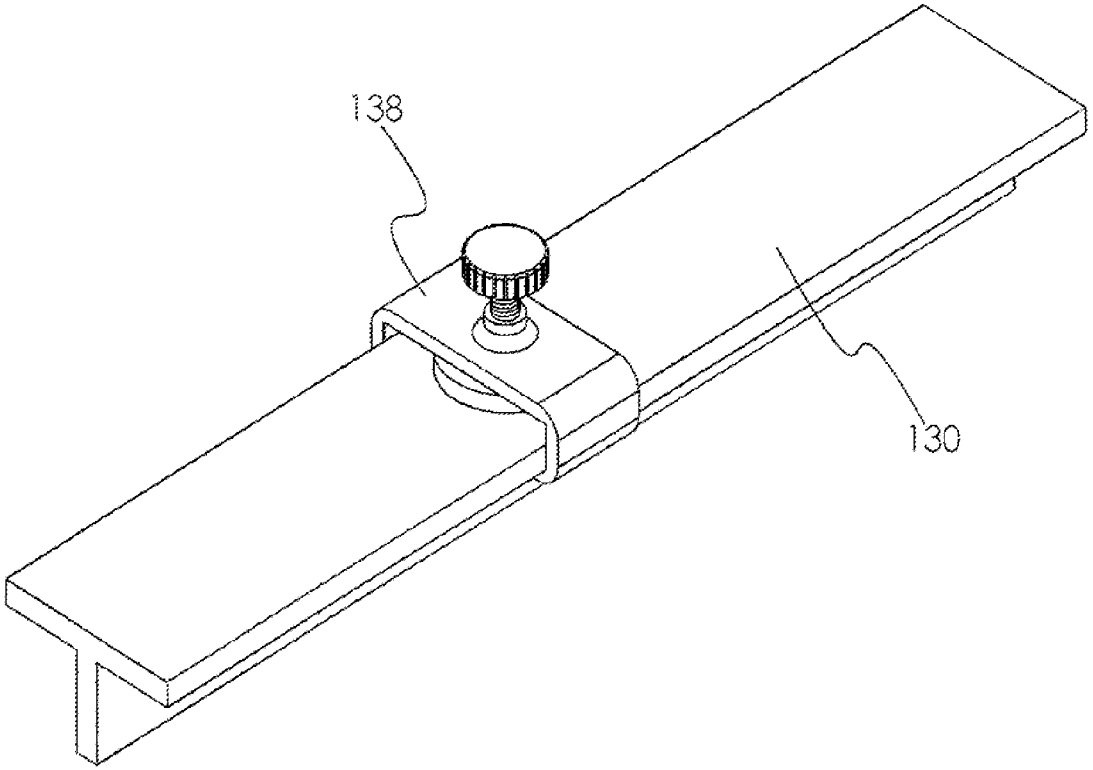
FIG. 10*b* shows a stopper attached to a track according to at least one embodiment of the present disclosure.
Figure 10C:
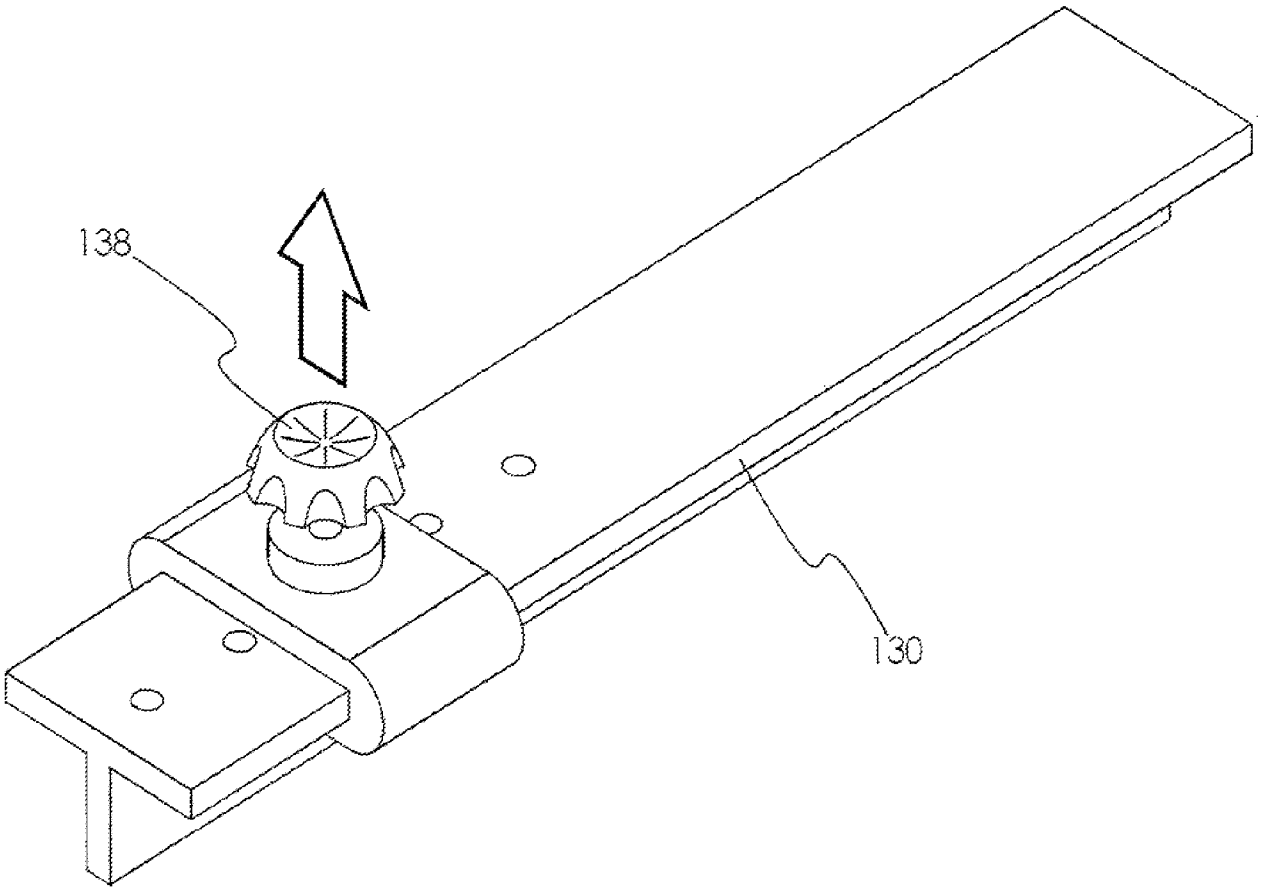
FIG. 10*c* shows a stopper attached to a track having a substantially T-shaped cross-section where a portion of the stopper is configured to be disposed within apertures of the track to lock the stopper on the track according to at least one embodiment of the present disclosure.
Figure 10D:
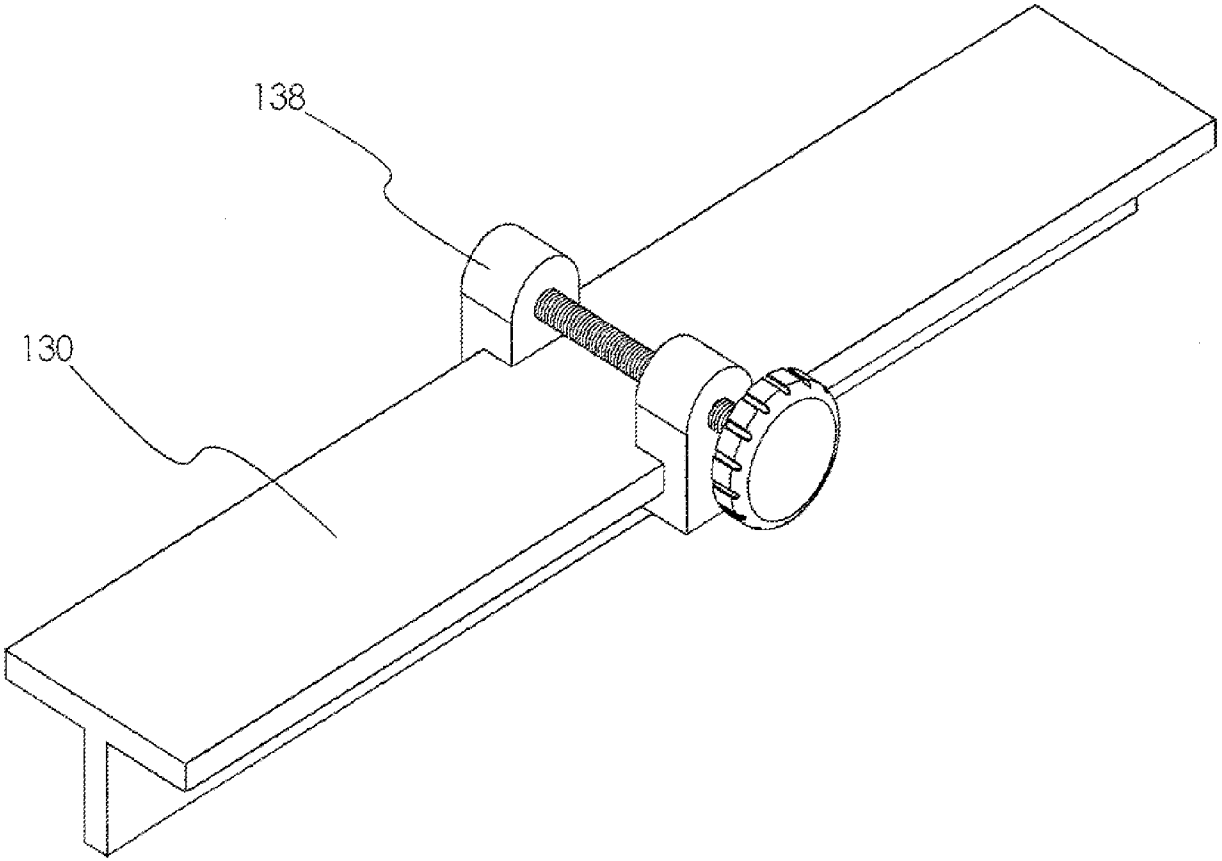
FIG. 10*d* shows a stopper attached to a track according to at least one embodiment of the present disclosure.
Figure 10E:
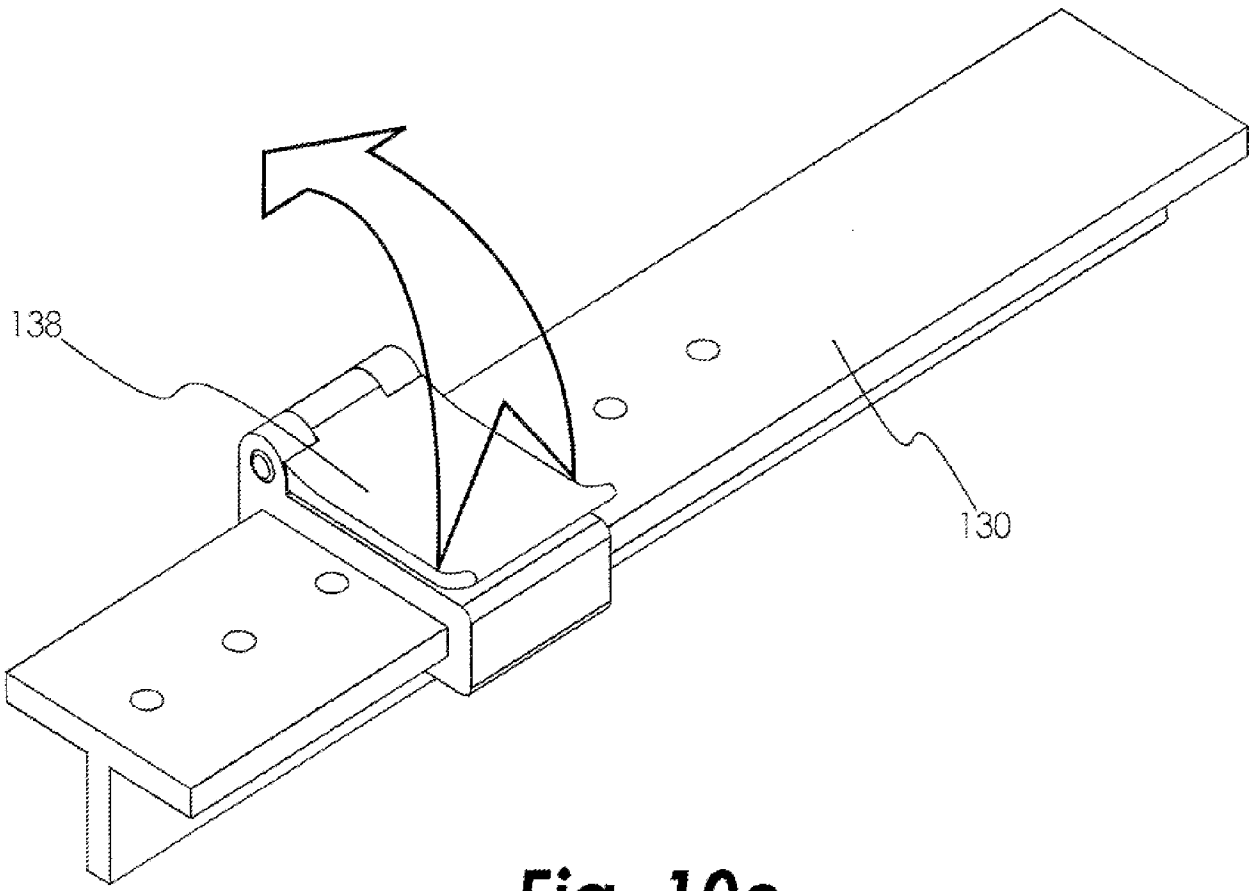
FIG. 10*e* shows a stopper attached to a track having a substantially T-shaped cross-section where the stopper includes a cam lever having a portion that is configured to be inserted within one of a plurality of apertures along the track to lock the stopper in place along the track according to at least one embodiment of the present disclosure.
Figure 10F:
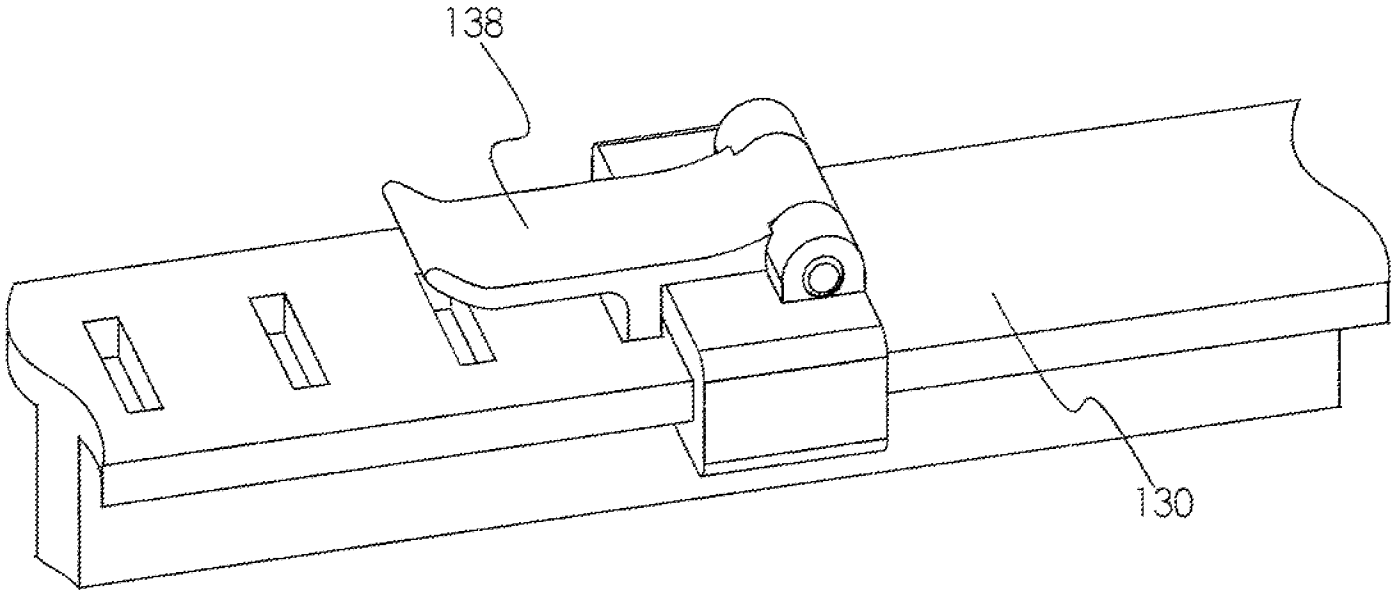
FIG. 10*f* shows a stopper attached to a track having a substantially T-shaped cross-section where the stopper includes a cam lever having a portion that is configured to be inserted within one of a plurality of apertures along the track to lock the stopper in place along the track according to at least one embodiment of the present disclosure.
Figure 10G:
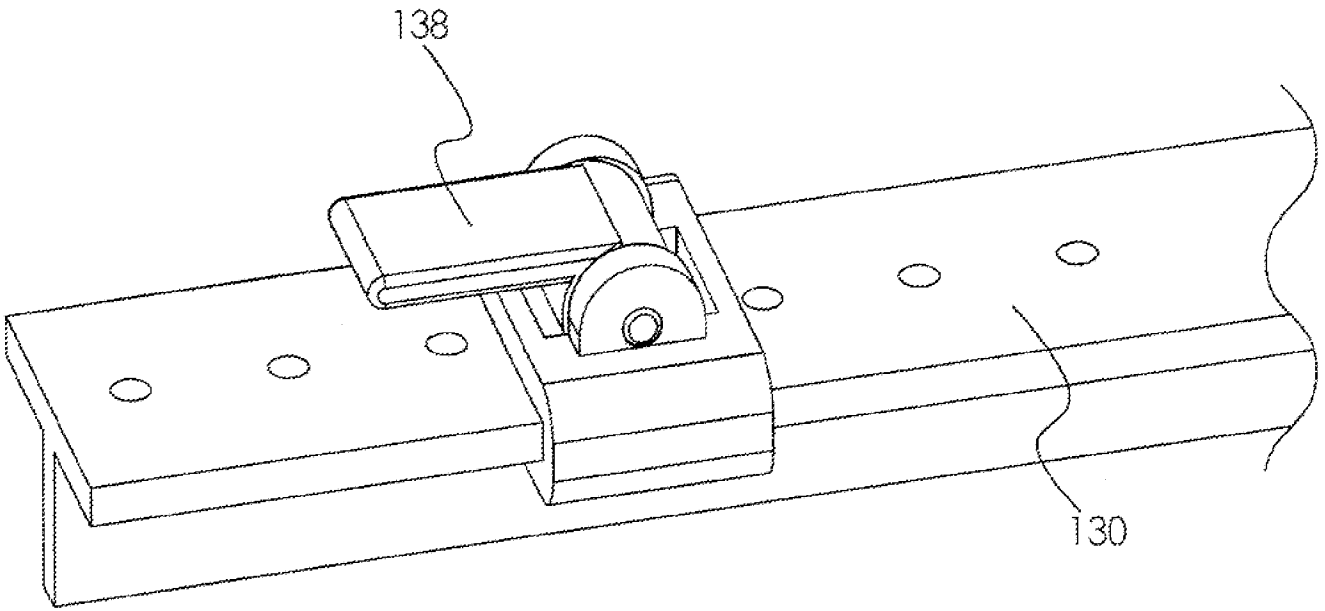
FIG. 10*g* shows a stopper attached to a track where the stopper includes a cam lever for locking the stopper in place along the track according to at least one embodiment of the present disclosure.

As illustratively shown in FIG. 1, the apparatus 100 may also include inner stoppers 129, 139 and outer stoppers 128, 138 that are configured to restrict the movement of handles 140, 150 along the tracks 120, 130. The stoppers 128, 129, 138, 139 may be various sizes and shapes. As shown in FIG. 1, the stoppers 128, 129, 138, 139 may be configured to substantially extend across the width of the tracks 120, 130. The inner and outer stoppers 128, 129, 138, 139 may be attached to the tracks 120, 130 in various ways. For example, a stopper may include a clamp for securing it to a track. As shown in the cross-section of stopper 138 in FIG. 10*a*, a stopper 138 may include a cam lever 138*a* that is positioned on top of the rail. In use, the cam lever 138*a* may be flipped down causing a pin 138*b* to be disposed in an aperture, thereby locking the stopper 138 in-place. When a user desires to move the stopper 138 to a different location on the track 130, the user can flip the cam lever 138*a* in an upright position so that the pin 138*b* is retracted from the aperture, thereby unlocking the stopper 138. In other examples, a track may include various holes for receiving bolts, threaded fasteners, or other devices to secure a stopper to the track. FIGS. 10*b*-10*g* illustrate various other examples of stoppers 128, 129, 138, 139. As shown in FIGS. 10*b*-10*g*, stoppers 128, 129, 138, 139 may involve various locking mechanisms, including screws and clamps. It should also be noted that stoppers 128, 129, 138, 139 may simply include a set screw secured within a threaded or unthreaded hole in the corresponding track, where a portion of the screw sticks out from the top surface of the track to impede the movement of the respective handle 140, 150. In at least one embodiment, the stoppers 128, 129, 138, 139 may be configured to be easily moved and secured along a track. This ability to manipulate the placement of the stoppers 128, 129, 138, 139 allows a user to define which portion of track the user will be permitted to move the handles within.

In at least one embodiment, the apparatus 100 may also include one or more sensors that are coupled with the stoppers 128, 129, 138, 139 and include an indicator such as a light, audio generation circuitry, or another indicator to notify the user he or she has completed a rep and/or count the number of reps, where a rep may be when one or more stoppers 128, 129, 138, 139 are touched by a handle. It should be noted that apparatus 100 may also include a computer (not shown), which may be positioned within the base member, for example, to record and otherwise interact with the sensors and other parts of the apparatus.

In at least one embodiment, the apparatus 100 may include a resistance system that increases the resistance that a user feels while moving the handles along the tracks. For instance, the resistance system may include increased friction between the handles and the tracks. For example, the top surface of the tracks may be designed such that the handles experience friction as they travel over the top surface (e.g., bumpy surface). In another example, the resistance system may include rubber bands or other elastic members that restrict the movement of the handles along the tracks. In at least one embodiment (not shown), the apparatus 100 may be configured as shown in FIG. 1 but may also include elastic members that couple the base member to the handles such that as the user moves the handles away from the base member, he or she experiences increased resistance. In at least one embodiment, the apparatus 100 may be configured as shown in FIG. 1 but may include or further include elastic members that couple the handles to the outer stoppers or other device near the ends of the tracks opposite the base member. In this latter embodiment, the user would experience resistance when the user moves the handles toward the base member and, if both such elastic members are provided on one or both tracks, the user would experience increased resistance in both directions for the handles. Of course, various other resistance systems may be included to increase the resistance experienced by the user.

Figure 10H:
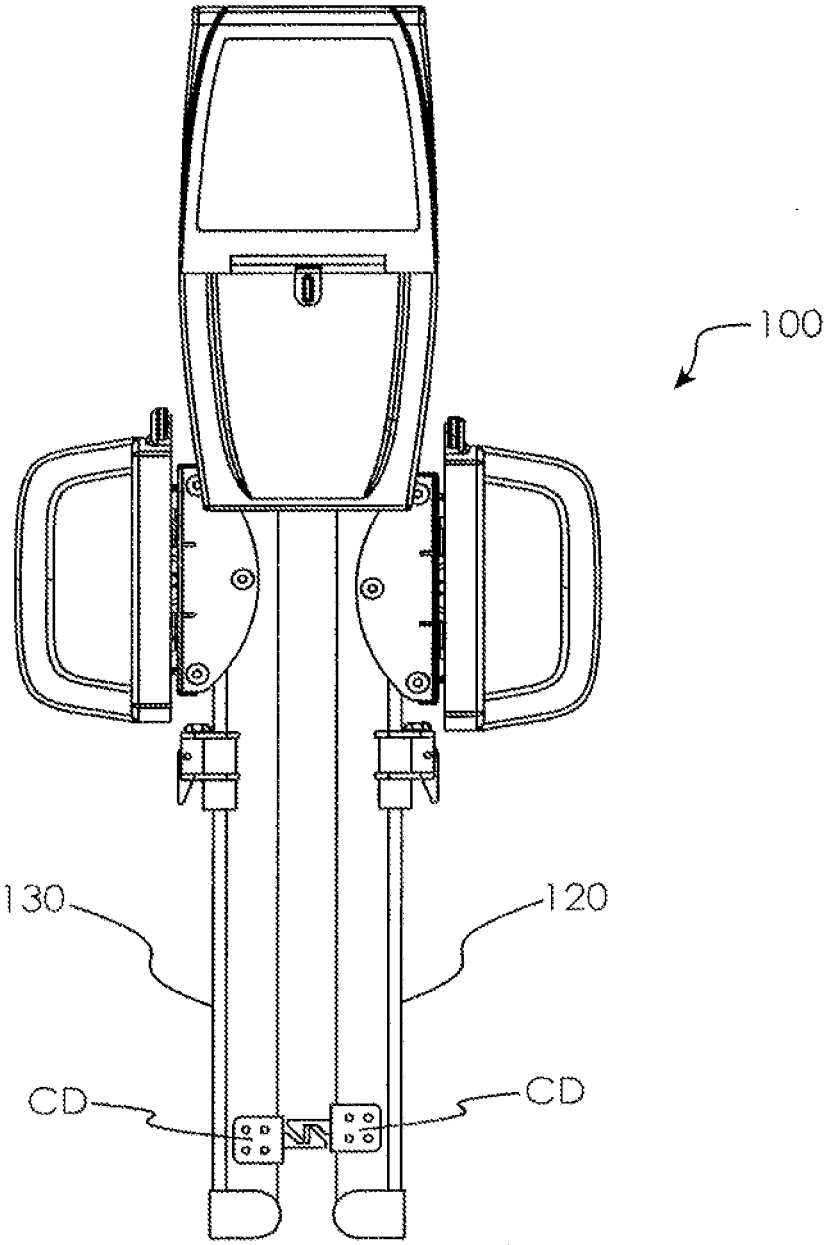
FIG. 10*h* shows an exercise apparatus having connector devices attached to tracks and attached to one another while the apparatus is in a folded configuration according to at least one embodiment of the present disclosure.

As described herein, the apparatus 100 may be configured to be easily transformed from a configuration for use to a configuration for storage or transportation and vice versa. For example, as a user lifts up on the base member 110 of apparatus 100 in the use configuration (e.g., FIG. 1), the end supports 160, 170 eventually lose contact with the ground and the apparatus 100 is completely above the ground. At this point, the tracks 120, 130 pivot about the second locking members 127 of the base member 100 until assuming the configuration of FIG. 5 where the tracks 120, 130 are positioned adjacent to one another. In one embodiment, a connector device may be attached to the first ends 121, 131 of tracks 120, 130 so that the tracks 120, 130 stay in the position shown in FIG. 5 and do not pivot from such position until the user moves the tracks 120, 130 or disengages the connector devices. In another embodiment, as shown in FIG. 10*h*, connector devices CD may be attached somewhere along the lengths of the tracks 120, 130 so that the tracks 120, 130 stay in the same position shown in FIG. 5 and do not pivot from such position until the user moves the tracks 120, 130. By limiting the movement of the tracks 120, 130, the connector devices CD make the apparatus 100 more stable in its storage or transportation configuration. The connector devices CD may include magnets, male and female snap members, hook and loop fasteners, straps, bands, and the like.

As mentioned herein, the exercise apparatus may also be used in the healthcare industry for a variety of medical and rehabilitative purposes. The apparatus may be configured to provide a user with particular exercises with the required supports and restrictions of movement. For example, a user with a surgically repaired shoulder may be able to use the apparatus described herein to strengthen the muscles in and around the surgical incisions, where the apparatus is set up to limit the movement of the user's arm to ranges of motion that are beneficial to the user.

Figure 11:
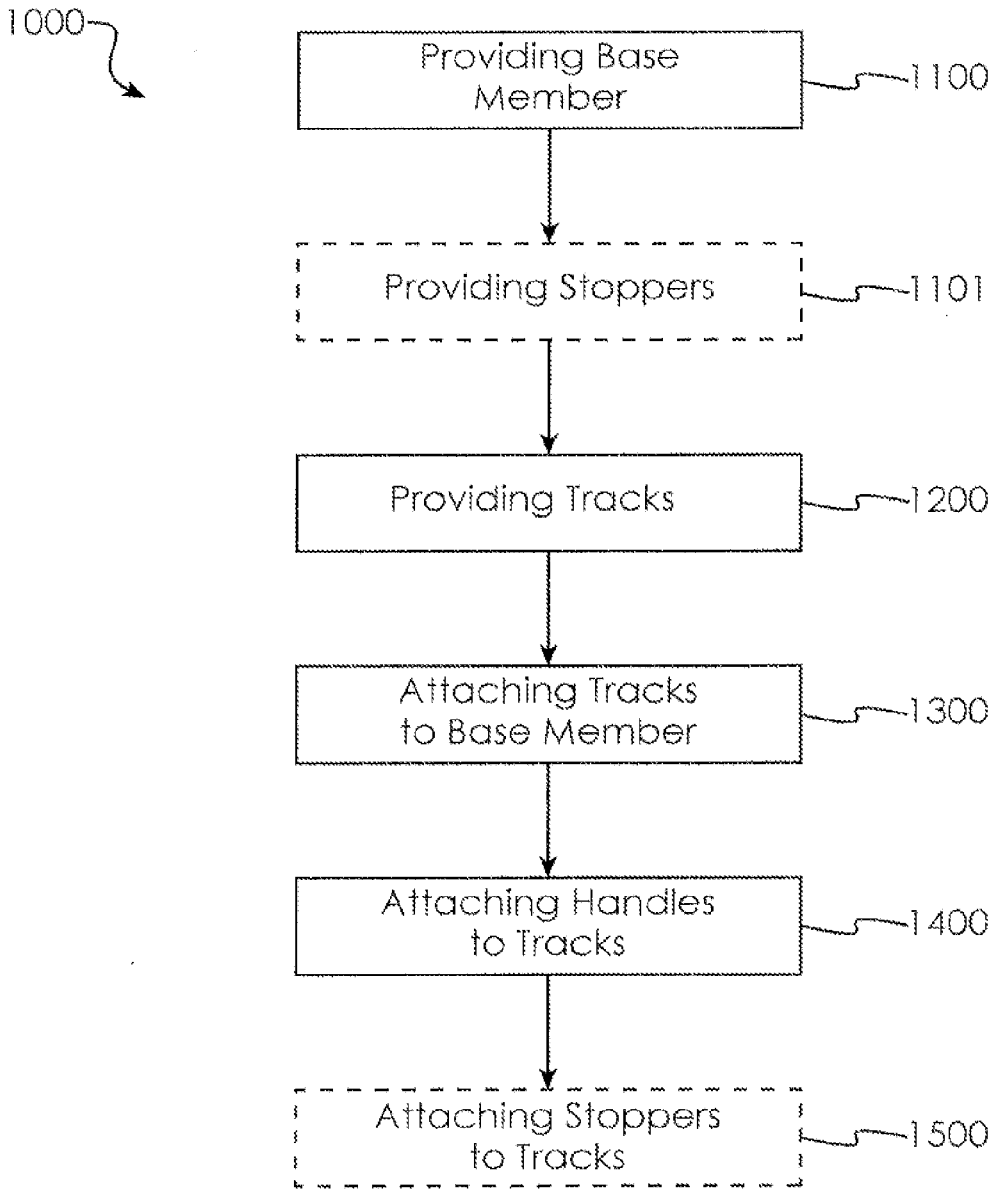
FIG. 11 shows a flowchart of a method of making a portable exercise apparatus according to at least one embodiment of the present disclosure.

One embodiment of a method of making a portable exercise apparatus is shown in FIG. 11. In FIG. 11, the method of making a portable exercise apparatus 1000 includes providing a base member having a first base locking system and a second base locking system 1100, providing a first elongate track and a second elongate track 1200, attaching the first elongate track and the second elongate track to the base member such that the first and second elongate track members are configured to extend away from the base member in substantially opposite directions 1300, and attaching a first handle to the first elongate track and a second handle to the second elongate track such that each handle is configured to move or slide along the respective track 1400. The method 1000 may also include providing a first outer stopper and a second outer stopper 1101 and attaching each stopper to one of the tracks such that one of the handles is substantially restricted from moving along the length of the corresponding track 1500.

Figure 12:
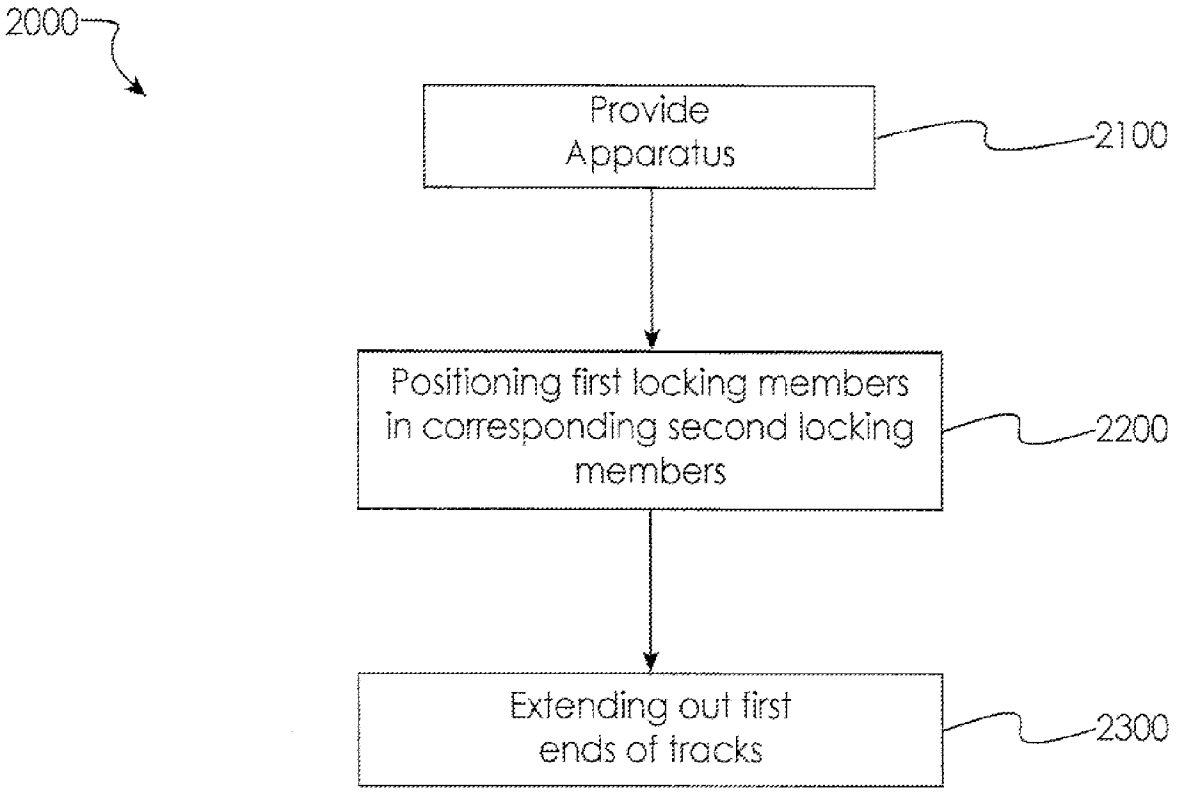
FIG. 12 shows a flowchart of a method of configuring an exercise apparatus according to at least one embodiment of the present disclosure.

One embodiment of a method of configuring an exercise apparatus is shown in FIG. 12. In FIG. 12, the method of configuring an exercise apparatus 2000 includes providing an apparatus having some or all of the features described above 2100, positioning the first locking member of each track in the desired one of the second locking members in the base member (to achieve the desired angle of incline and couple each track to the base member) 2200, and extending the first ends of the tracks outwardly (e.g., substantially parallel with the ground or in a declined or inclined position as described above) 2300.

Figure 13:
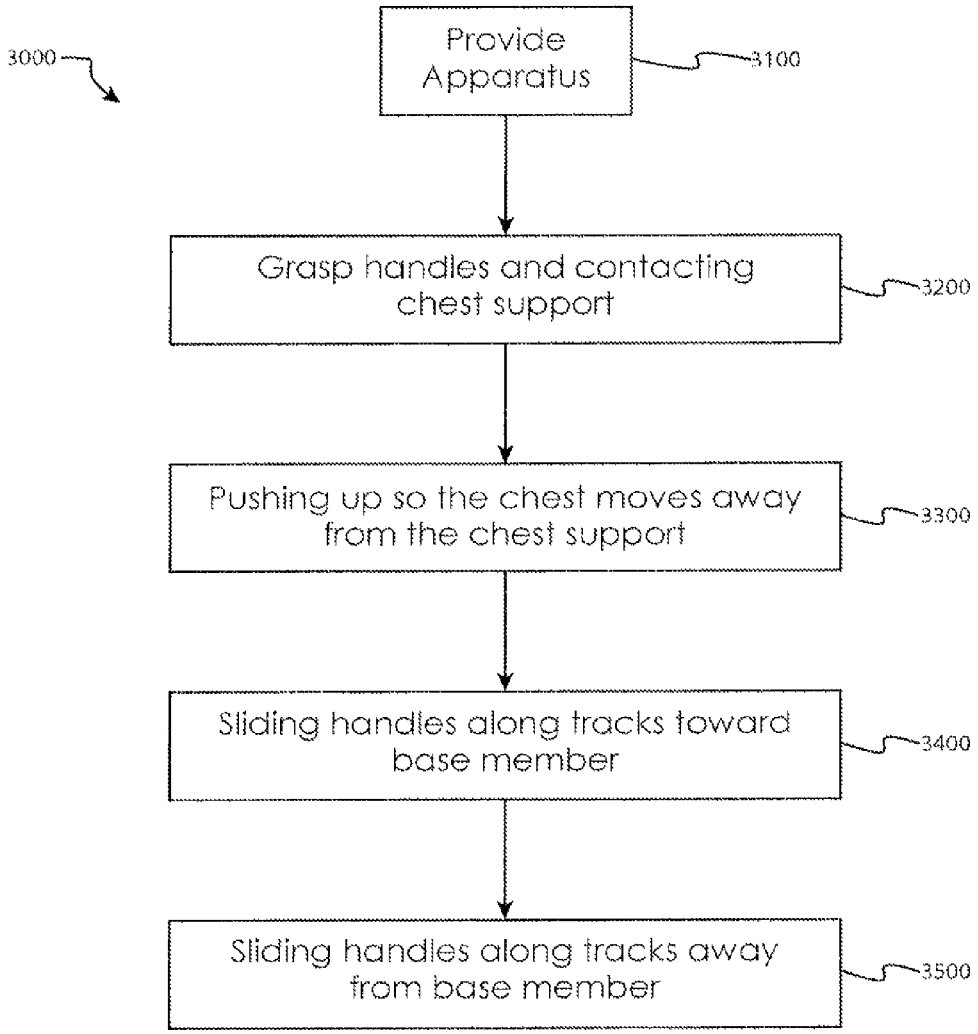
FIG. 13 shows a flowchart of a method of using the apparatus after being configured for use according to at least one embodiment of the present disclosure.

One embodiment of a method of using the apparatus after being configured for use is shown in FIG. 13. In FIG. 13, the method of using the apparatus after being configured for use 3000 includes providing an apparatus in a configuration for use 3100, grasping the handles of the apparatus and contacting the user's chest on the chest support 3200, and pushing up so the user's chest moves away from the chest support 3300. The method 3000 also includes as the user pushes up, sliding the handles along the tracks toward the base member until the user is substantially fully extending the user's arms 3400. The method 3000 further includes sliding the handles in the opposite direction along the tracks, away from the base member, until the user's chest again contacts the chest support, completing the repetition cycle 3500.

Figure 14:
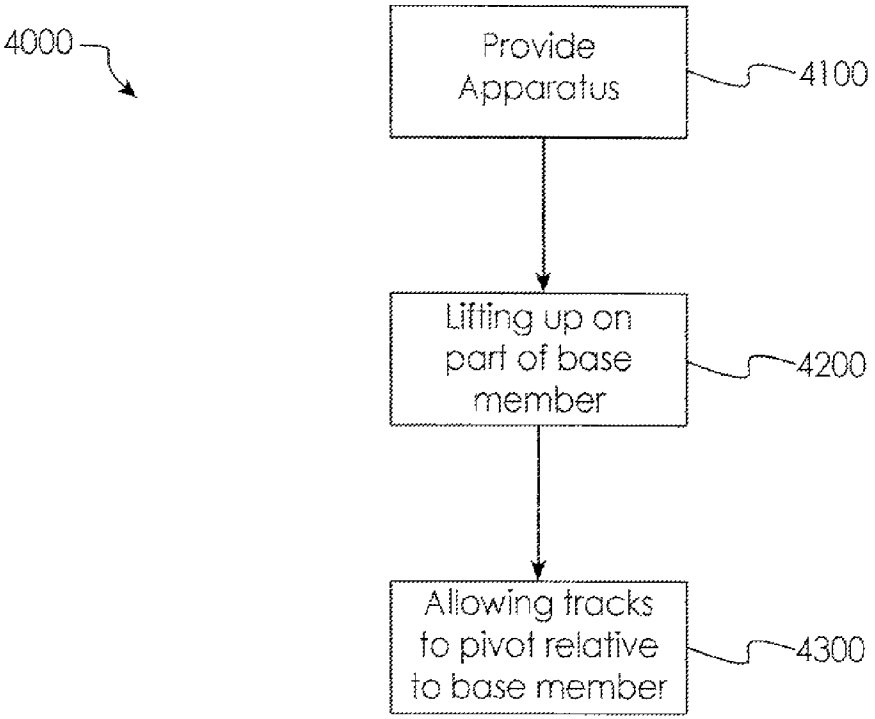
FIG. 14 shows a method of stowing an exercise apparatus according to at least one embodiment of the present disclosure.

One embodiment of a method of stowing an exercise apparatus is shown in FIG. 14. In FIG. 14, the method of stowing an exercise apparatus 4000 includes providing an apparatus as described herein 4100, lifting up on a part of the base member 4200 so that the base member is lifted up from the ground, allowing the tracks to pivot relative to the base member until the end supports are adjacent one another and the tracks are approximately parallel 4300. Illustratively, the end supports or the first ends of the tracks may be secured together in some fashion, such as, for example, using snaps, magnets, and the like (as shown in FIG. 10*i*).

While this disclosure has been described as having various embodiments, these embodiments according to the present disclosure can be further modified within the scope and spirit of this disclosure. This application is therefore intended to cover any variations, uses, or adaptations of the disclosure using its general principles. For example, any methods disclosed herein represent one possible sequence of performing the steps thereof. A practitioner may determine in a particular implementation that a plurality of steps of one or more of the disclosed methods may be combinable, or that a different sequence of steps may be employed to accomplish the same results. Each such implementation falls within the scope of the present disclosure as disclosed herein and in the appended claims. Furthermore, this application is intended to cover such departures from the present disclosure as come within known or customary practice in the art to which this disclosure pertains.

What is claimed is:

1. An exercise apparatus comprising:

a base member;

a first elongate track and a second elongate track, each track coupled to the base member such that each track is configured to extend away from the base member in the opposite direction relative to the other track, wherein the first and second elongate the tracks are vertically moveable along at least a portion of a length of the base member;

a first handle slidably coupled to the first elongate track such that the first handle is movable along the length of the first elongate track; and a second handle slidably coupled to the second elongate track such that the second handle is movable along the length of the second elongate track, wherein the first and second elongate tracks are rotatably coupled to the base member such that each track is adapted to pivot about the base member allowing the tracks to be arranged extending away from the base member in the same direction.

2. The exercise apparatus of claim 1, further comprising:

a first outer stopper and first inner stopper, each stopper configured to attach to the first elongate track and define a portion of a first elongate movement that the first handle is restricted to move within.

3. The exercise apparatus of claim 2, further comprising:

a second outer stopper and second inner stopper, each stopper configured to attach to the second elongate track and define a portion of a second elongate movement that the second handle is restricted to move within.

4. The exercise apparatus of claim 1, wherein at least one of the first elongate track and second elongate track comprises a substantially T-shaped cross-section.

5. The exercise apparatus of claim 1, further comprising a cushion attached to the base member and configured to receive the chest of a user of the apparatus, wherein the cushion is configurable to different heights above the base member.

6. The exercise apparatus of claim 1 wherein the base member includes a stability flap configured to substantially stabilize the apparatus.

7. The exercise apparatus of claim 1, wherein a first grip portion of the first handle is configured to rotate in place about an axis perpendicular to a longitudinal axis of the first elongate track, and wherein a second grip portion of the second handle is configured to rotate in place about an axis perpendicular to a longitudinal axis of the second elongate track.

8. The exercise apparatus of claim 1, further comprising:

a first stand and a second stand attached to the first track and second track, respectively, opposite the base member and configured to, along with the base member, support the respective track.

9. An exercise apparatus comprising:

a base member;

a first elongate track and a second elongate track coupled to one another and to the base member, wherein each track is configured to extend away from the base member in the opposite direction relative to the other track and wherein the first and second elongate tracks and base member are coupled through a removable pin, each elongate track being moveable along a length of the base member so that each elongate track is vertically moveable between attachment positions along at least a portion of the length of the base member;

a first handle slidably coupled to the first elongate track such that the first handle is movable along the length of the first elongate track; and a second handle slidably coupled to the second elongate track such that the second handle is movable along the length of the second elongate track, wherein the first and second elongate tracks are removable from the base member by removing the pin, a first grip portion of the first handle is configured to rotate in place about an axis perpendicular to a longitudinal axis of the first elongate track, and a second grip portion of the second handle is configured to rotate in place about an axis perpendicular to a longitudinal axis of the first elongate track.

10. The exercise apparatus of claim 9, wherein at least one of the first elongate track and second elongate track comprises a T-shaped cross-section.

11. The exercise apparatus of claim 9, further comprising:

a first outer stopper and first inner stopper, each stopper configured to attach to the first elongate track and define a portion of the first elongate movement that the first handle is restricted to move within; and a second outer stopper and second inner stopper, each stopper configured to attach to the second elongate track and define a portion of the second elongate movement that the second handle is restricted to move within.

12. The exercise apparatus of claim 9 wherein the base member includes a stability flap configured to substantially stabilize the apparatus.

13. The exercise apparatus of claim 9, wherein the first and second elongate tracks are rotatably coupled to the base member such that each track is adapted to pivot about the base member allowing the tracks to be arranged extending away from the base member in the same direction.

14. The exercise apparatus of claim 9, further comprising:

a first stand and a second stand attached to the first track and second track, respectively, opposite the base member and configured to, along with the base member, support the respective track.

15. The exercise apparatus of claim 1, further comprising attachment positions along the length of the base member, the first and second elongate tracks moveable along at least a portion of the length of the base member between the attachment positions.

16. The exercise apparatus of claim 1, wherein the first and second elongate tracks are each moveable along the length of the base member to form different angles of incline with respect to a surface upon which the base member rests.

17. The exercise apparatus of claim 9, wherein the first and second elongate tracks are each moveable along the length of the base member to form different angles of incline with respect to a surface upon which the base member rests.

18. An exercise apparatus comprising:

a base member;

a first elongate track and a second elongate track coupled to one another and to the base member, wherein each track is configured to extend away from the base member in the opposite direction relative to the other track and wherein the first and second elongate tracks and base member are coupled through a removable pin, each elongate track being moveable along a length of the base member so that each elongate track is vertically moveable between attachment positions along at least a portion of the length of the base member;

a first handle slidably coupled to the first elongate track such that the first handle is movable along the length of the first elongate track; and a second handle slidably coupled to the second elongate track such that the second handle is movable along the length of the second elongate track, wherein the first and second elongate tracks are removable from the base member by removing the pin, wherein the first and second elongate tracks are rotatably coupled to the base member such that each track is adapted to pivot about the base member allowing the tracks to be arranged extending away from the base member in the same direction.

19. The exercise apparatus of claim 18, wherein at least one of the first elongate track and second elongate track comprises a T-shaped cross-section.

20. The exercise apparatus of claim 18, further comprising:

a first outer stopper and first inner stopper, each stopper configured to attach to the first elongate track and define a portion of the first elongate movement that the first handle is restricted to move within; and a second outer stopper and second inner stopper, each stopper configured to attach to the second elongate track and define a portion of the second elongate movement that the second handle is restricted to move within.

21. The exercise apparatus of claim 18 wherein the base member includes a stability flap configured to substantially stabilize the apparatus.

22. The exercise apparatus of claim 18, wherein a first grip portion of the first handle is configured to rotate in place about an axis perpendicular to a longitudinal axis of the first elongate track, and wherein a second grip portion of the second handle is configured to rotate in place about an axis perpendicular to a longitudinal axis of the first elongate track.

23. The exercise apparatus of claim 18, further comprising:

a first stand and a second stand attached to the first track and second track, respectively, opposite the base member and configured to, along with the base member, support the respective track.

24. The exercise apparatus of claim 18, wherein the first and second elongate tracks are each moveable along the length of the base member to form different angles of incline with respect to a surface upon which the base member rests.

* * * * *